US010358808B2

(12) United States Patent
Komatsu et al.

(10) Patent No.: US 10,358,808 B2
(45) Date of Patent: Jul. 23, 2019

(54) TOILET DEVICE

(71) Applicant: LIXIL Corporation, Tokyo (JP)

(72) Inventors: Toshihiko Komatsu, Tokyo (JP); Hiroaki Watanabe, Tokyo (JP); Yasuyuki Furutani, Tokyo (JP); Ryosuke Nakamura, Tokyo (JP); Tomoya Sasaki, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 15/755,541

(22) PCT Filed: Aug. 29, 2016

(86) PCT No.: PCT/JP2016/075149
§ 371 (c)(1),
(2) Date: Feb. 26, 2018

(87) PCT Pub. No.: WO2017/038744
PCT Pub. Date: Mar. 9, 2017

(65) Prior Publication Data

US 2018/0238037 A1 Aug. 23, 2018

(30) Foreign Application Priority Data

Aug. 31, 2015 (JP) ..... 2015-171223

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/443–448
See application file for complete search history.

(56) References Cited

U.S. PATENT DOCUMENTS

| | | | | |
|---|---|---|---|---|
| 4,797,959 | A * | 1/1989 | Decaux | E03D 9/002 4/662 |
| 8,161,580 | B2 * | 4/2012 | Hashidume | E03D 9/08 4/420.4 |
| 2017/0067240 | A1 | 3/2017 | Komatsu et al. | |

FOREIGN PATENT DOCUMENTS

| | | |
|---|---|---|
| JP | 60-250139 | 12/1985 |
| JP | 2002-146883 | 5/2002 |
| JP | 4728029 | 7/2011 |
| JP | 2012-233402 | 11/2012 |
| WO | 2015/159686 | 10/2015 |

OTHER PUBLICATIONS

International Search Report dated Nov. 1, 2016, directed to International Application No. PCT/JP2016/075149; 2 pages.
Extended European Search Report dated Apr. 23, 2019, directed to European Application No. 16841776.4; 7 pages.

* cited by examiner

*Primary Examiner* — Lori L Baker
(74) *Attorney, Agent, or Firm* — Morrison & Foerster LLP

(57) ABSTRACT

A toilet device includes a private part cleaning device, a warm air dying device, and a shutter and, when drying a private part using the warm air drying device, the shutter is configured to rotate such that a rear surface is directed toward an upper side and open an outlet, and the warm air drying device is configured to blow out warm air from the outlet to the rear surface of the shutter directed to the upper side and to cause the warm air guided by the shutter to be blown out to the private part side.

6 Claims, 13 Drawing Sheets

TOILET DEVICE

REFERENCE TO RELATED APPLICATIONS

This application is a national stage application under 35 USC 371 of International Application No. PCT/JP2016/075149, filed Aug. 29, 2016, which claims the priority of Japanese Application No. 2015-171223, filed Aug. 31, 2015, the entire contents of each of which are incorporated herein by reference.

FIELD OF THE INVENTION

The present invention relates to a toilet device.

BACKGROUND OF THE INVENTION

There are toilet bowl flushing devices including a private part cleaning device which cleans a private part after using the toilet. A private part cleaning device includes a private part cleaning nozzle that advances and retreats and appears and disappears between the inner side of a toilet main body and a cover case and a nozzle cover through a nozzle opening in accordance with a remote controller operation or the like. Then, together with the advancement of the private part cleaning nozzle, a shutter that opens and closes the nozzle opening is pressed to tilt and open the nozzle opening, and cleaning water is discharged from a tip end part of the private part cleaning nozzle that has advanced to the inner side of the toilet main body, whereby the private part can be cleaned.

In addition, there is a warm air drying device, similar to the private part cleaning nozzle, configured to include a warm air nozzle that is housed inside a cover case and appears and disappears on a toilet main body in accordance with opening and closing of a shutter and to dry the private part of a human body by blowing warm air from the tip end side of the warm air nozzle that has advanced on the toilet main body to the upper side (for example, see Patent Document 1).

Patent Document 1: Japanese Unexamined Patent Application, First Publication No. 2012-233402

SUMMARY OF THE INVENTION

However, a warm air drying device including a warm air nozzle is configured to blow warm air from the tip end part of the warm air nozzle. For this reason, the air volume of warm air becomes small, and the air blowing range of the warm air and the drying range according to the warm air become small (narrow).

In view of this, development of techniques for increasing the air blowing range of warm air and the drying range according to the warm air and efficiently drying the private part of the human body using warm air is desirable.

The present invention is in consideration of the situation described above, and an object thereof is to provide a toilet device enabling appropriate drying by blowing warm air in a wide range after cleaning the private part.

In order to solve the problems described above, the present invention employs the following aspects.

According to one aspect of the present invention, a toilet device includes: a private part cleaning device which includes a private part cleaning nozzle that cleans a private part, that is provided so as to be appeared and disappeared through a nozzle opening, and that is configured to discharge cleaning water from a tip end part in a state in which the private part cleaning nozzle is advanced to a front side; a warm air dying device which is configured to dry the private part and blow out warm air from an outlet after the cleaning the private part by the private part cleaning device; and a shutter which is configured to open and close the outlet. When drying the private part by the warm air drying device, the shutter is configured to rotate to a lower side of the outlet such that a rear surface is directed toward an upper side and opens the outlet. The shutter is configured such that the warm air is blown out from the outlet to the rear surface of the shutter that is directed toward the upper side, the warm air hits the shutter, and the warm air is blown out toward the upper private part.

In the toilet device described above, at the time of warm air drying, warm air can be blown out toward the rear surface directed toward the upper side of the shutter rotated to the lower side, and the warm air can be delivered to the private part side by being reflected on the rear surface of the shutter. In this way, by delivering warm air to the private part side by reflecting the warm air on the shutter, compared to a conventional case, even when the warm air is blown out in a fixed direction from the outlet, by reflecting the warm air on the rear surface of the shutter, the warm air can be delivered to a wide range of the private part side.

In addition, in this case, by adjusting and controlling the rotation angle of the shutter at the time of warm air drying, the blowing direction of the warm air reflected on the rear surface of the shutter can be easily adjusted and controlled, and an arbitrary drying position can be easily set.

In this way, according to the toilet device described above, compared to a conventional case, after cleaning the private part, cleaning water adhering to a human body can be dried efficiently and effectively using warm air.

In the toilet device described above, a portion of the rear surface of the shutter where the warm air hits may be formed in a smooth recessed curved shape for blowing the warm air to the private part side.

In such a case, by forming a part of the rear surface of the shutter, which is hit by the warm air, directed toward the upper side at the time of warm air drying in a smooth recessed curved shape, the warm air blown out to the rear surface of the shutter can be appropriately guided and delivered to the private part side in accordance with the shape of the rear surface.

In this way, according to the toilet device described above, the loss of warm air that deviates greatly from the private part side when blown is decreased, and the cleaning water adhering to the human body can be dried more efficiently and effectively.

In the toilet device described above, when drying the private part, the shutter may be configured to forwardly and reversely rotate and thereby swing.

In such a case, at the time of warm air drying, the shutter rotated such that the rear surface is directed to the upper side is forwardly and reversely rotated to swing, and accordingly, the warm air blown out toward the rear surface of the shutter can be delivered to a wide range by using the shutter.

In this way, the cleaning water adhering to the human body can be dried more efficiently and effectively. In addition, even when there is a position difference in the private part depending on a user sitting on the toilet seat, by blowing out warm air in a wide range by using the swinging shutter, the cleaning water can be dried reliably.

In the toilet device described above, the shutter may be configured such that a center of an air flow bundle of the warm air blown out from the outlet is configured to hit a further inner side portion of the toilet main body than a center of the shutter rotated to cause the rear surface to be directed toward the upper side.

In such a case, warm air is blown out from the outlet such that the center of the air flow of the warm air hits a further inner side portion of the toilet main body than the center of the shutter, and accordingly, the warm air can be appropriately guided to the private part and blown. In this way, the loss of warm air that deviates greatly from the private part side when blown is decreased, and the cleaning water adhering to the human body can be dried more efficiently and effectively.

In the toilet device described above, an air direction adjusting unit adjusting a flow direction of the warm air to be blown out from the outlet in a horizontal direction may be provided in the outlet.

In such a case, the air direction adjusting unit is provided in the outlet of the warm air, and the warm air can be blown out to the rear surface of the shutter by adjusting the horizontal air direction of the warm air by using the air direction adjusting unit, and it is unnecessary to adjust the horizontal air blowing direction using the shutter. In this way, a rib or the like used for the adjustment of the air direction does not need to be arranged on a face of a portion of the rear surface of the shutter at which the warm air is received, and the face receiving the warm air can be formed in a smooth face shape, whereby the shutter can be easily cleaned.

In the toilet device described above, a lid member that is configured to open the outlet together with the blowing-out of the warm air and to close the outlet together with the stopping of the blowing-out of the warm air may be provided in the outlet.

In this case, the lid member opens the outlet together with the blowing-out of the warm air, and warm air can be delivered to the private part side by reflecting the warm air on the rear surface of the shutter. In addition, when the blowing-out of the warm air is stopped, the lid member closes the outlet, and contaminants, a spray of cleaning water, or the like can be prevented from entering the inside through the outlet.

In a toilet device according to an aspect of the present invention, the private part can be dried appropriately by blowing warm air in a wide range after cleaning the private part.

DETAILED DESCRIPTION OF THE INVENTION

Hereinafter, a toilet device according to an embodiment of the present invention will be described with reference to FIGS. 1 to 22. Here, while the toilet device according to the present invention will be described as being a flushing-type toilet bowl in this embodiment, a toilet device according to the present invention may include at least a private part cleaning device and a warm air drying device.

Figure 1:
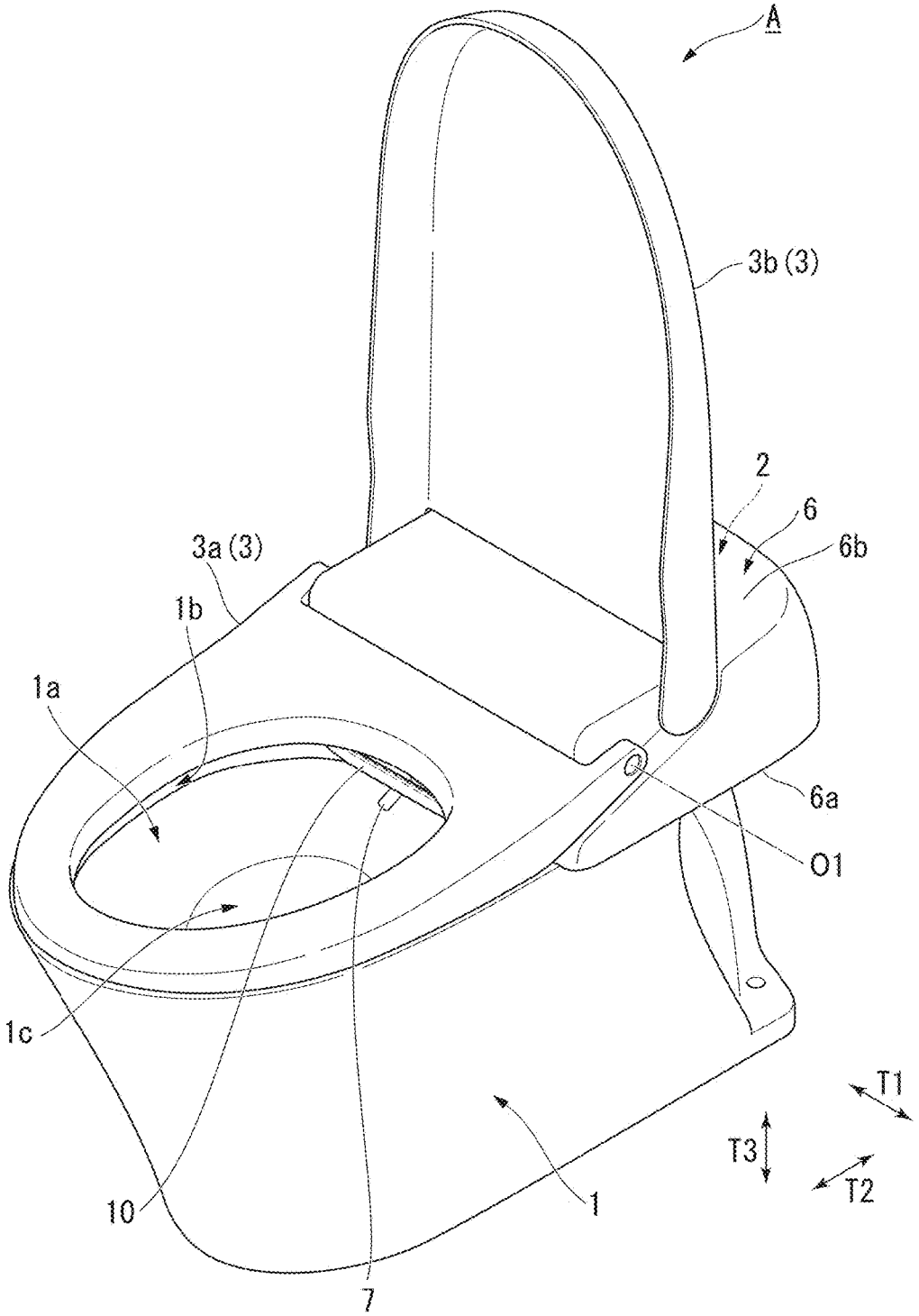
FIG. 1 is a perspective view showing a flushing-type toilet bowl (toilet device) according to one embodiment of the present invention.
Figure 2:
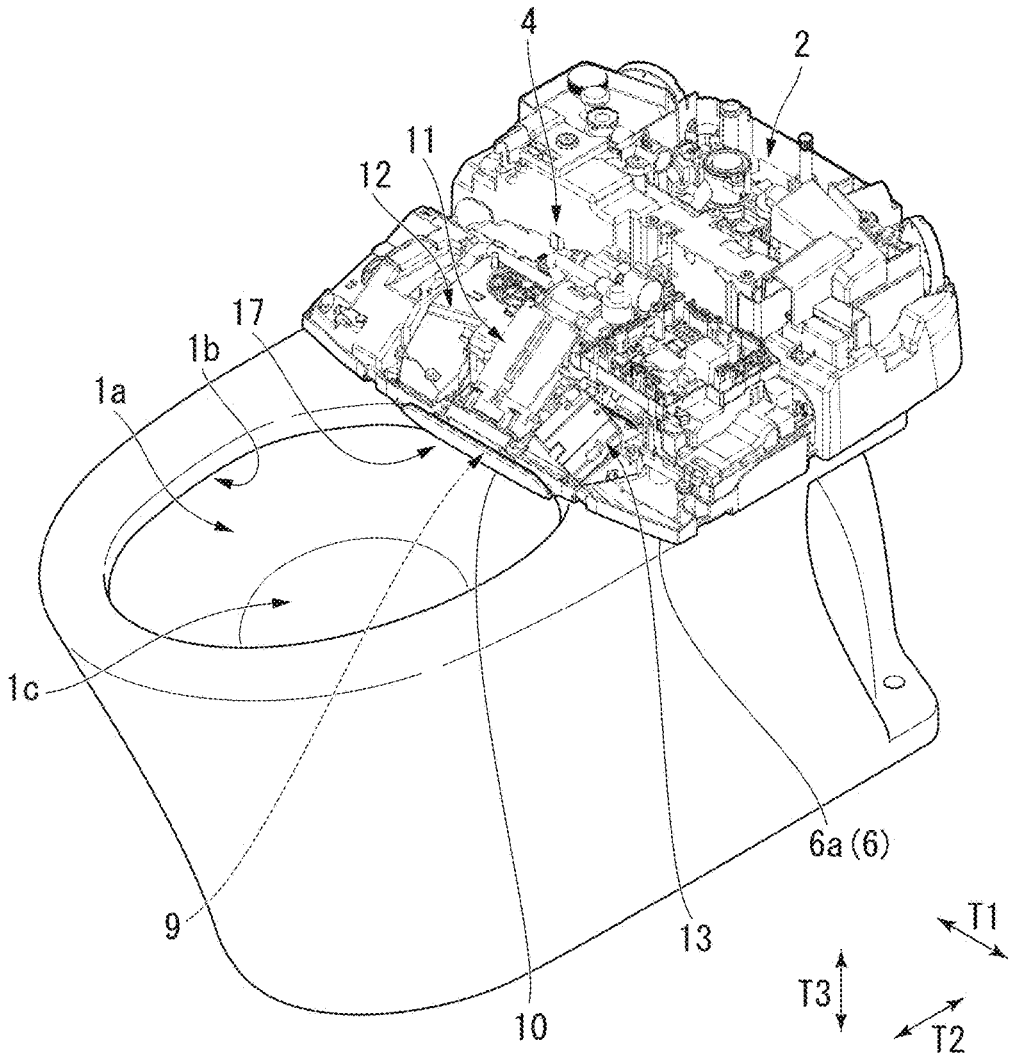
FIG. 2 is a perspective view showing a flushing-type toilet bowl according to one embodiment of the present invention in a state in which a toilet seat and a cover case are removed.

First, a flushing-type toilet bowl A according to this embodiment, as shown in FIGS. 1 and 2, is configured to include: a toilet main body 1; a cleaning mechanism unit 2 that is provided in a rear part side (toward a rear part) of the toilet main body 1 and, for example, detects a remote controller operation performed by a user and discharges cleaning water to the inside of the toilet main body 1; and a toilet seat unit 3 formed by a toilet seat 3*a* and a toilet lid 3*b*.

Figure 3:
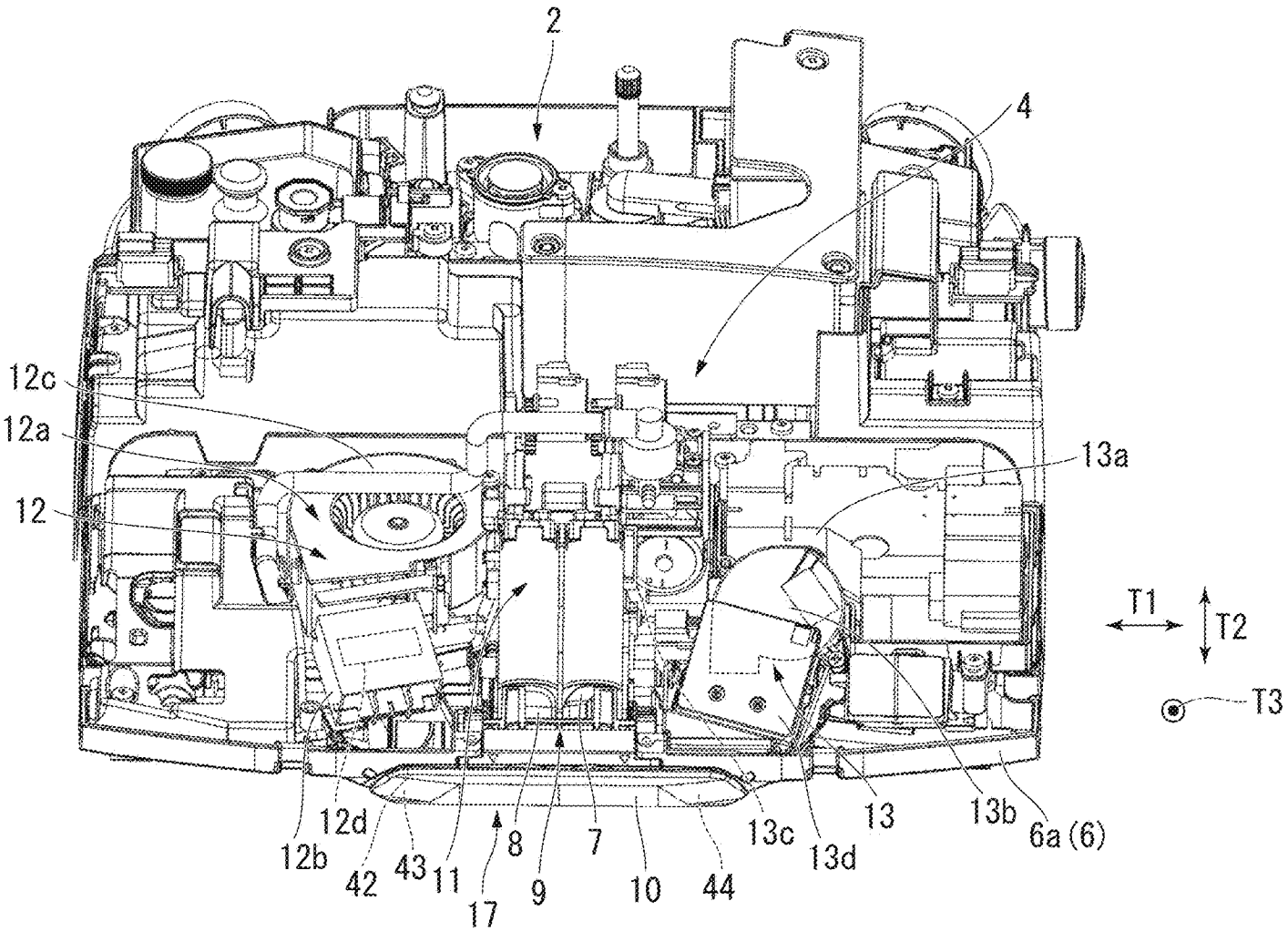
FIG. 3 is a perspective view showing the inside of a cover case of a flushing-type toilet bowl according to one embodiment of the present invention.

In addition, the flushing-type toilet bowl A, as shown in FIGS. 1 to 3, includes a private part cleaning device 4 that cleans the private part after using the toilet.

The toilet main body 1 is formed to include a ball part 1*a* of the bowl and a rim part 1*b* that is provided in an upper part of the ball part 1*a* and forms the outer peripheral edge while protruding to the inner side of the toilet main body 1.

The cleaning mechanism unit 2 is integrally provided so as to be detachably attached to the rear part side of the toilet main body 1, and is provided so as to be housed inside a cover case 6. In addition, the cleaning mechanism unit 2 includes an open-close valve such as a control valve or a solenoid valve controlling the opening and closing of a cleaning water flow path, for example, by a remote controller operation. The cleaning mechanism unit 2 is configured to perform switching between rim discharge water and jet discharge, and controlling the flow rate of discharged water by the open-close valve. The rim discharge water causes cleaning water to flow through the rim part 1*b* of the toilet main body 1. The jet discharge water causes cleaning water to flow through the ball part 1*a* and a water sealing part 1*c* of the toilet main body 1.

The cover case 6 is configured to include a base (base plate) 6*a* that is provided in an upper surface of the rear part of the toilet main body 1 and a cover (outer shell body) 6*b* that is assembled with the base 6*a* and forms a housing space.

Figure 5:
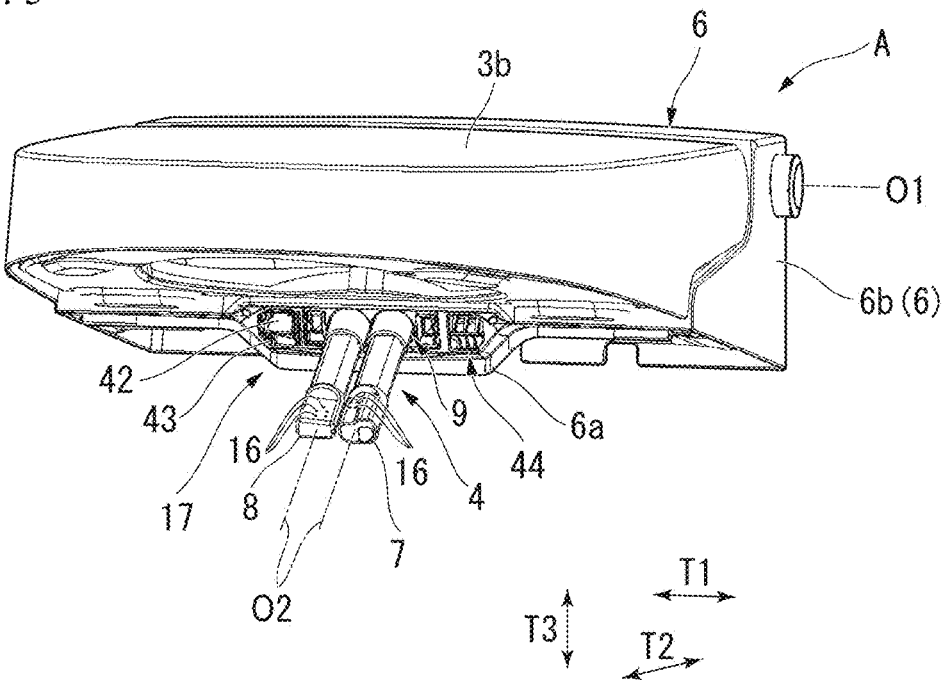
FIG. 5 is a perspective view showing a private part cleaning nozzle of a flushing-type toilet bowl according to one embodiment of the present invention.

The toilet seat unit 3 configured by the toilet seat 3*a* and the toilet lid 3*b*, as shown in FIGS. 1 and 5, is detachably attached to the cover case 6 and is provided to be freely rotatable around a rotation shaft O1 (vertical direction) extending in a horizontal direction T1.

The private part cleaning device 4, as shown in FIGS. 1 to 5, includes private part cleaning nozzles 7 and 8 that are provided and housed inside the cover case 6 together with the cleaning mechanism unit 2, and advance to the inside of the toilet main body 1, for example, by a remote controller operation and a shutter 10.

The shutter 10 causes the nozzle opening 9 provided in the cover case 6 to be opened and closed, and causes the nozzle opening 9 to be opened in accordance with an advancement operation of the private part cleaning nozzles 7 and 8 to the inside of the toilet main body 1 when cleaning the private part. The private part cleaning nozzles 7 and 8 are housed inside the cover case 6 and the shutter 10 caused the nozzle opening 9 to be closed. That is, the shutter 10 is provided in order to prevent contaminants, a spray of cleaning water, or the like from being caught in the private part cleaning nozzles 7 and 8 or entering the inside thereof.

In the private part cleaning device 4, when cleaning the private part, the private part cleaning nozzles 7 and 8 advance to the inner side of the toilet main body 1 in accordance with a remote controller operation or the like, and the tip end parts of the private part cleaning nozzles 7 and 8 press the rear surface of the shutter 10 to rotate the shutter 10 to be open. Then, the private part cleaning device 4 is configured such that cleaning water is discharged from the tip end parts of the private part cleaning nozzles 7 and 8 that advance to the inner side (inside) of the toilet main body 1 for cleaning. After cleaning the private part, the private part cleaning nozzles 7 and 8 retreat, and the pressed state of the shutter 10 is released, whereby the shutter 10 is automatically rotated to close the nozzle opening 9.

More specifically, the private part cleaning device 4 according to this embodiment, as shown in FIGS. 2 to 6, includes: a nozzle unit 11 that is arranged at the center of the base 6*a* of the cover case 6; a warm water supplying unit that supplies warm water used for cleaning the private part to the nozzle unit 11; a warm air drying unit (warm air drying device) 12 that dries the private part after cleaning using warm air; and a deodorizing unit (deodorizing device) 13.

Figure 6:
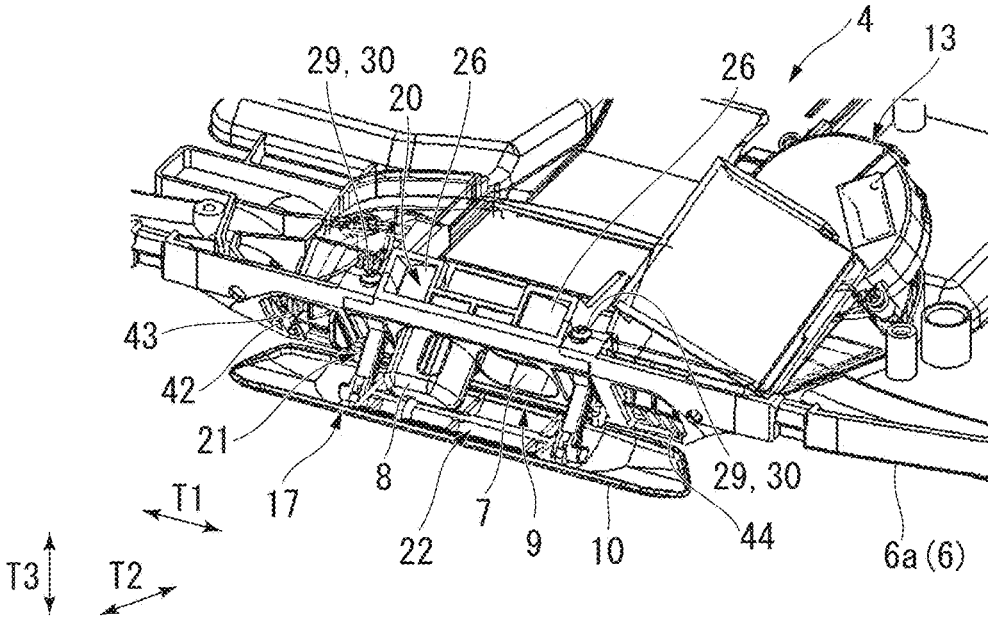
FIG. 6 is a perspective view showing a private part cleaning device of a flushing-type toilet bowl according to one embodiment of the present invention.
Figure 7:
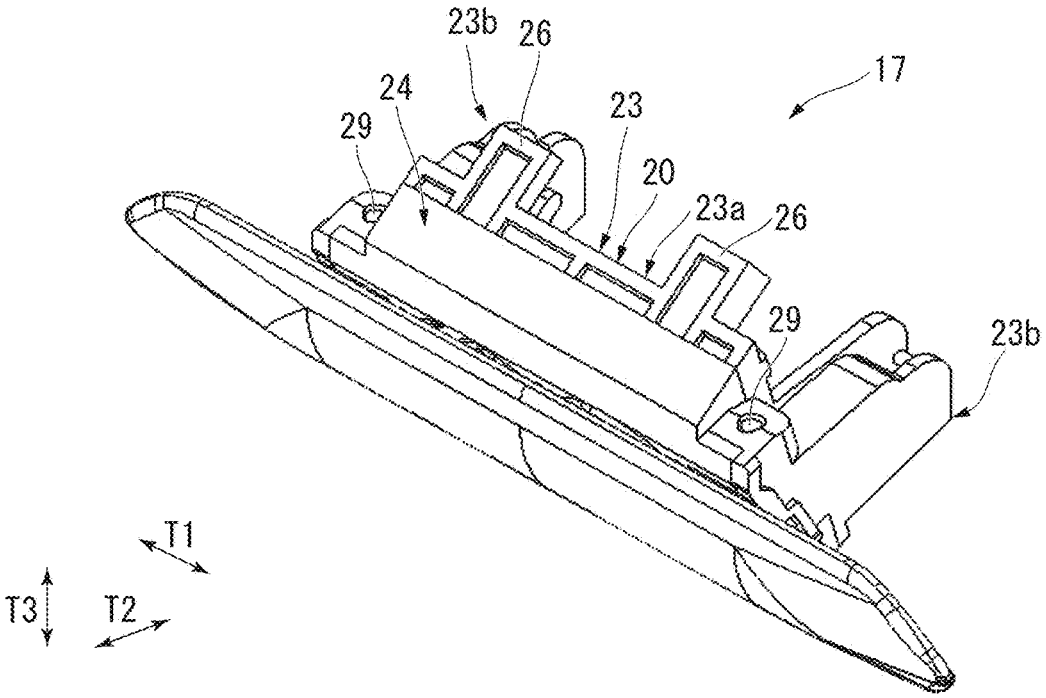
FIG. 7 is perspective view showing a shutter unit of a flushing-type toilet bowl according to one embodiment of the present invention.

The nozzle unit 11, as shown in FIGS. 5 and 6, includes one pair of private part cleaning nozzles (twin nozzles) 7 and 8 including a nozzle for washing the anus and a nozzle for a bidet and a nozzle cover 15 that includes the one pair of private part cleaning nozzles 7 and 8 therein. The one pair of private part cleaning nozzles 7 and 8 according to this embodiment gradually incline to the lower side toward the front side and are arranged in parallel with axial lines O2 in the same direction. In addition, each of the private part cleaning nozzles 7 and 8 includes a discharge hole 16 used for discharging cleaning water in a tip end part positioned on the lower side, and cleaning water that is supplied from the rear end side and flows through it is configured to be discharged in a predetermined direction from the discharge hole 16.

Each of the one pair of private part cleaning nozzles 7 and 8 is formed in an approximately cylindrical rod shape and is provided so as to freely advance or retreat in the direction of the axial lines O2 (forward-backward direction T2) with respect to the nozzle opening 9 provided in the center of the front surface of the nozzle 6*a*. Each of the one pair of private part cleaning nozzles 7 and 8 advances from the nozzle opening 9 to the front side to protrude to the inner side of the toilet main body 1 at the time of cleaning and is housed and maintained inside the nozzle cover 15 and the cover case 6 through the nozzle opening 9 after cleaning.

Here, in this embodiment, the forward-backward direction T2 will be described to include an approximately forward-backward direction.

For example, each of the one pair of private part cleaning nozzles 7 and 8 is caused to individually advance or retreat in the direction of the axial line O2 by a rack and pinion mechanism. In other words, in this embodiment, a rack is integrally formed on the lower surface of each of the private part cleaning nozzles 7 and 8, and the private part cleaning nozzles 7 and 8 are arranged such that racks are engaged with pinions attached to the rotation shaft of a motor.

In this way, when the motor and the pinions rotate in one direction in accordance with a remote controller operation or the like, the private part cleaning nozzles 7 and 8 forward in the direction of the axial line O2 and protrude to the inner side of the toilet main body 1 through the nozzle opening 9. On the other hand, when the motor and the pinions rotate in the other direction in accordance with a remote controller operation or the like, the private part cleaning nozzles 7 and 8 move rearward in the direction of the axial line O2 to be housed, and the private part cleaning nozzles 7 and 8 are housed inside the nozzle cover 15 and the cover case 6 through the nozzle opening 9.

Figure 4:
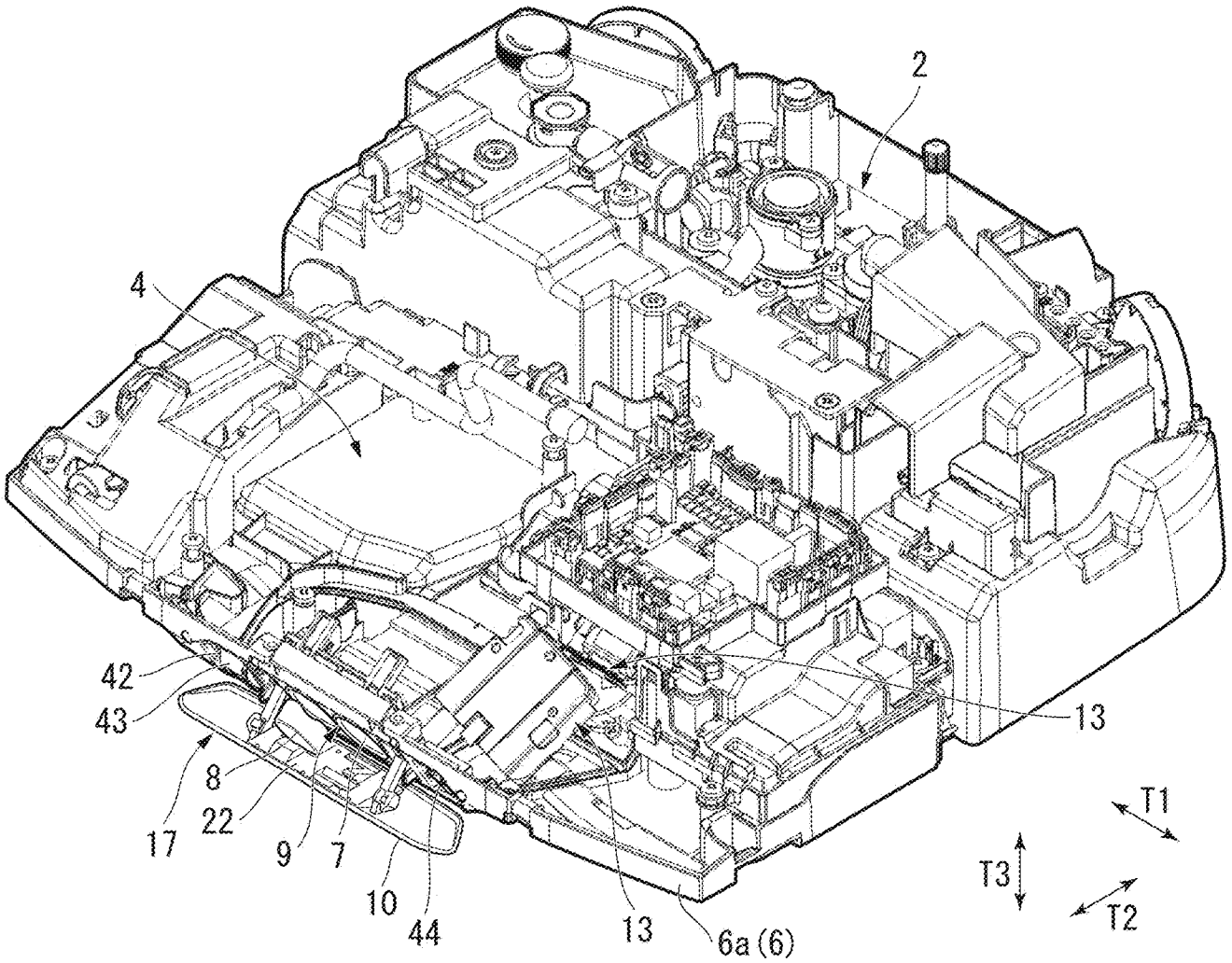
FIG. 4 is a perspective view showing the inside of a cover case of a flushing-type toilet bowl according to one embodiment of the present invention.

Here, in the private part cleaning device 4 according to this embodiment, the shutter 10 is included in a shutter unit (shutter opening-closing mechanism) 17. The shutter of this shutter unit 17, as shown in FIGS. 2, 3, and 6, closes the nozzle opening 9 in a state in which the one pair of private part cleaning nozzles 7 and 8 are housed inside the cover case 6 to prevent contaminants, a spray of cleaning water, or the like from being caught in the private part cleaning nozzles 7 and 8 or entering the inside thereof. In addition, this shutter, as shown in FIGS. 1, 4, and 5, rotates together with the advancement of the private part cleaning nozzles 7 and 8 to open the nozzle opening 9.

The shutter unit 17 according to this embodiment, as shown in FIGS. 6 to 9, is configured to include: a shutter base 20 that is used for being positioned and fixed to be detachably attached to the nozzle opening 9 of the base 6*a* of the cover case 6; a shutter arm 21 that is arranged so as to cause the rear end side to be supported by the shutter base 20; a shutter receiver 22 that is arranged and connected to the shutter arm 21 so as to be attachable and detachable and rotatable with respect to the shutter arm 21; and a shutter 10 that is arranged so as to be overlapping on the front side of the shutter receiver 22 and connected to the shutter arm 21 so as to be attachable and detachable and rotatable with respect to the shutter arm 21.

The shutter base 20, as shown in FIGS. 6 to 9, 10, 11, 12, and 13, includes: a first base 23 that is provided in a rearmost part of the shutter unit 17; and a second base 24 that is detachably attached to the front surface of the first base 23.

The first base 23 includes a main body part 23*a* and arm holding parts 23*b* that are provided in both side portions of the main body unit 23*a* in the width direction (horizontal direction T1).

The main body part 23*a* of the first base 23 is recessed from the lower end to the upper end side and includes a fitting part (engagement part) 25 fitted to the nozzle cover 15 of the private part cleaning device 4. The main body part 23*a* of the first base 23 includes one pair of projecting parts (engagement parts) 26 arranged to extend from the rear surface to the rear side at positions having a predetermined gap interposed therebetween on the sides of the both side parts from the center of the upper end side in the width direction, and is configured to be engaged with the nozzle cover 15 by engaging a projecting part formed in the nozzle cover 15 between the one pair of projecting parts 26. In the main body part 23*a* of the first base 23, screw insertion holes 27 passing through from the rear surface to the front surface are provided on both side part sides of the upper end thereof in the width direction (see FIG. 11).

The arm holding parts 23*b* integrally arranged in both side portions of the main body part 23*a* of the first base 23 in the width direction are formed in a cylindrical shape having an approximate square-shaped cross-section and are arranged to extend with the direction of the center axis line directed toward the forward-backward direction T2 that is toward the rear surface side from the front surface side to open toward the front surface side (toward the front surface) and the rear surface side (toward the rear surface).

The second base 24 is configured to include: a main body part 24*a*; a base engaging part (engagement part) 24*b* engaged with the base 6*a* of the cover case 6; and arm insertion parts 24*c* provided on both side portions of the main body part 24*a* in the width direction.

The main body part 24*a* of the second base 24 is formed to dispose one pair of nozzle insertion parts 28 that protrude from the front surface to the rear surface and that inserts the one pair of private part cleaning nozzles 7 and 8 to advance or retreat on the left and right sides having the center in the width direction interposed between. In the main body part 24*a* of the second base 24, female screw holes that are recessed from the rear surface to the front surface side and are screwed in a female screw pattern on the rear surface are formed on both sides of the upper end in the width direction.

Figure 10:
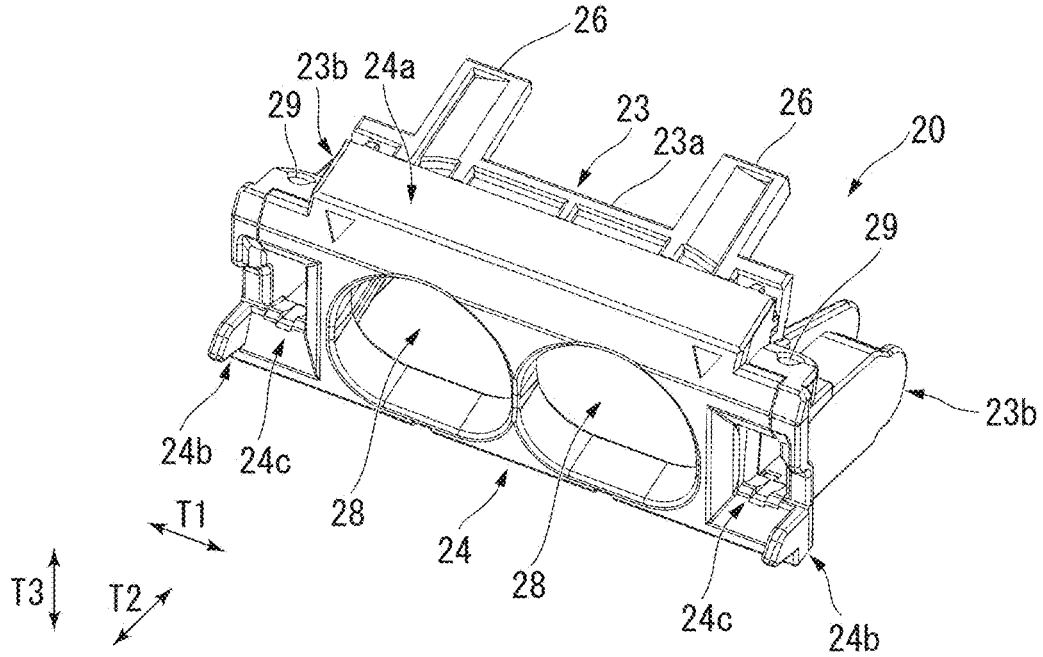
FIG. 10 is a perspective view showing a shutter base of a shutter unit of a flushing-type toilet bowl according to one embodiment of the present invention.
Figure 11:
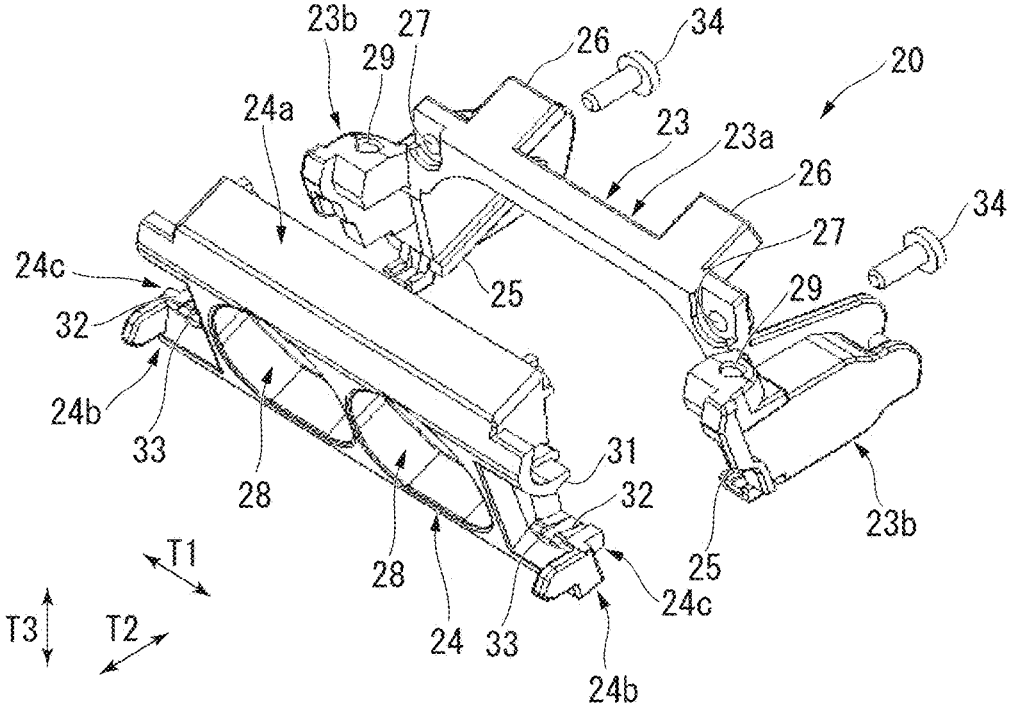
FIG. 11 is an exploded perspective view showing a shutter base of a shutter unit of a flushing-type toilet bowl according to one embodiment of the present invention.
Figure 12:
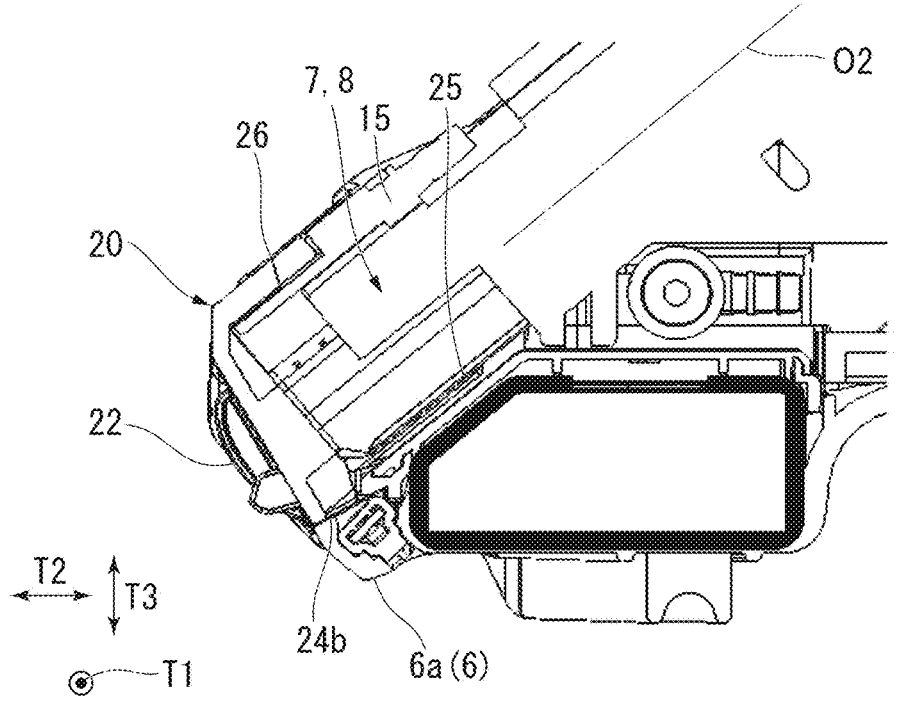
FIG. 12 is a side cross-sectional view showing a state in which a shutter base of a shutter unit of a flushing-type toilet bowl according to one embodiment of the present invention is installed in a nozzle opening while engaged with a nozzle unit.
Figure 13:
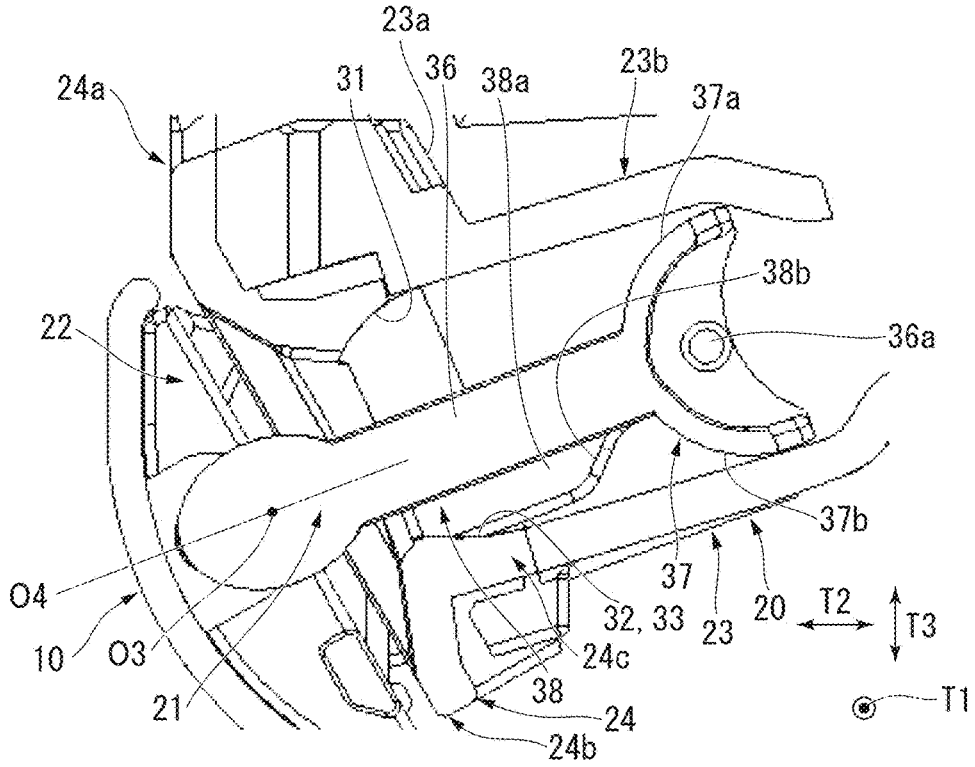
FIG. 13 is a side cross-sectional view showing a connection portion between an arm part of a shutter arm of a shutter unit and a shutter base of a flushing-type toilet bowl according to one embodiment of the present invention.

As shown in FIGS. 10, 11, and 13, the arm insertion parts 24*c* provided in both end portions of the main body part 24*a* of the second base 24 in the width direction are provided to extend in the forward-backward direction T2 that is toward the rear surface side from the front surface side to open toward the front surface side and the rear surface side. On the front end side of each of the arm insertion parts 24*c*, an upper rotation locking surface 31 extending from the upper surface to the lower side is provided. In addition, on the front end side of each of the arm insertion parts 24*c*, a lower rotation locking surface 32 extending from the lower surface to the upper side is provided. The upper rotation locking surface 31 and the lower rotation locking surface 32 are formed in the shape of arc surfaces of concentric circles.

In the lower rotation locking surface 32, a guide groove 33 that is recessed from the lower rotation locking surface 32 to the lower side and extends from the rear end to the front end is formed at the approximate center in the width direction.

The first base 23 and the second base 24 described above are engaged with each other in a bonding state in which the first base and the second base are arranged at predetermined relative positions while bringing the rear surface of the second base 24 into surface contact with the front surface of the first base 23. The first base 23 and the second base 24 are held in a state in which relative movement between the vertical direction T3 and the horizontal direction T1 is regulated.

The first base 23 and the second base 24 are connected together to be detachably attached by causing the screw insertion hole 27 and the female screw hole to communicate with each other in the bonding state of being engaged with each other and causing a screw 34 to be inserted into and pass through the screw insertion hole 27 from the rear surface side of the first base 23 and to be screwed into the female screw hole of the second base 24.

In the state in which the first base 23 and the second base 24 are connected together, the arm holding part 23*b* of the first base 23 and the arm insertion part 24*c* of the second base 24 are arranged to communicate with each other by arranging the center axial lines thereof on the same axis.

As shown in FIG. 6, when the shutter base 20 formed by connecting the first base 23 and the second base 24 is arranged at a predetermined position on the base 6*a* of the cover case 6, the female screw hole 29 formed on the upper end side of the arm insertion part 24*c* of the second base 24 communicates with the screw insertion hole formed in the base 6*a*. In addition, by fastening the screw 30 into the female screw hole 29 through the screw insertion hole, the shutter base 20 is fixed to a predetermined position on the base 6*a*.

Figure 14:
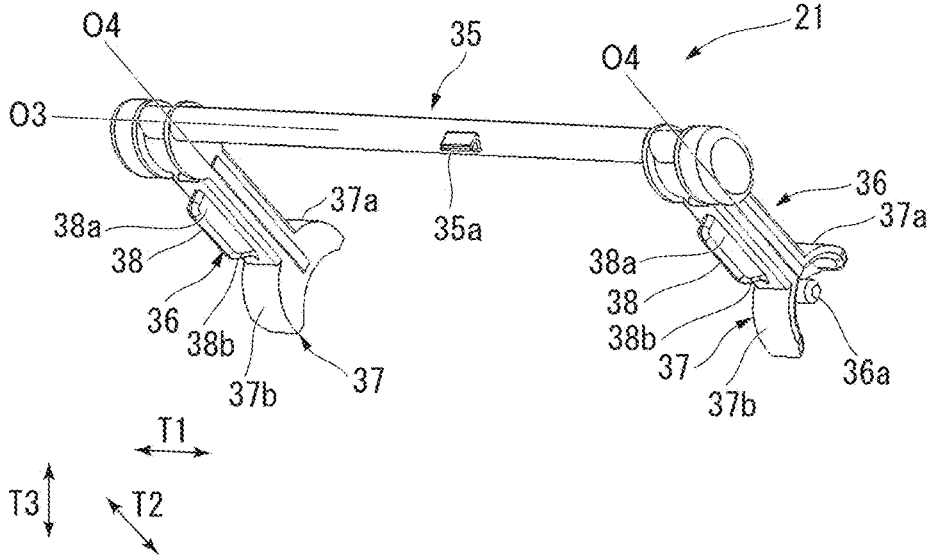
FIG. 14 is a perspective view showing a shutter arm of a shutter unit of a flushing-type toilet bowl according to one embodiment of the present invention.

The shutter arm 21, as shown in FIGS. 13 and 14, includes a shaft part 35 having the direction of an axial line O3 arranged toward the horizontal direction T1 and one pair of arm parts 36, which have approximate square-shaped cross-sections, connected to the front end sides (one end side) of both end portion sides of the shaft part 35 and provided to extend in a direction orthogonal to the axial line O3 of the shaft part 35 in parallel with each other and is formed in an approximate "U" shape. Here, the arm part 36 is not limited to being necessarily formed to have an approximate square-shaped cross-section.

In this embodiment, the shaft part 35 of the shutter arm 21 is formed in a cylinder rod shape and is formed to include a locking piece part 35*a* that protrudes from the outer face and is used for holding the shutter receiver 22.

On the rear end side (the other end side) of the arm part 36, a spring connection part 36*a* used for hanging a spring member (not shown in the drawing) over the base 6*a* and the arm part 36 to be connected thereto through an opening formed on the rear end side of the arm holding part 23*b* to be attachable and detachable so as to bias the shutter arm 21 to the rear side inside of the cover case is provided to protrude.

In each of the one pair of arm parts 36, on the rear side (on a further front end side than the spring connection part 36*a*), a rotation part 37 including an upper rotation surface 37*a* extending from the upper surface to the upper side and a lower rotation surface 37*b* extending from the lower surface to the lower side is provided. The upper rotation surface 37*a* and the lower rotation surface 37*b* are formed in the shape of arc surfaces of concentric circles. In addition, the upper rotation surface 37*a* and the lower rotation surface 37*b* of the rotation part 37 are formed as arc surfaces having the same radius of curvature as that of the upper rotation locking surface 31 and the lower rotation locking surface 32 of the arm insertion part 24*c*.

Each arm part 36 includes a rib 38 that protrudes from the lower surface to the lower side and extends in the forward-backward direction T2 of the extending direction of the arm part 36 at the approximate center of the lower surface in the width direction. The rib 38 is provided in the range of a predetermined length from a further rotation part 37 side than the front end of the arm part 36 to a further front end side than the rotation part 37. In addition, this rib 38 is formed to include: a support protrusion part 38*a* that extends to the rear end side with a fixed protrusion length from the front end and maintains the direction of an axial line O4 (the extending direction) of the arm part 36 to be fixed at the time of advancement-retreatment of the arm part 36; and an inclining part 38*b* having a smaller protrusion length toward the rear end from the support protrusion part 38*a*.

Figure 8:
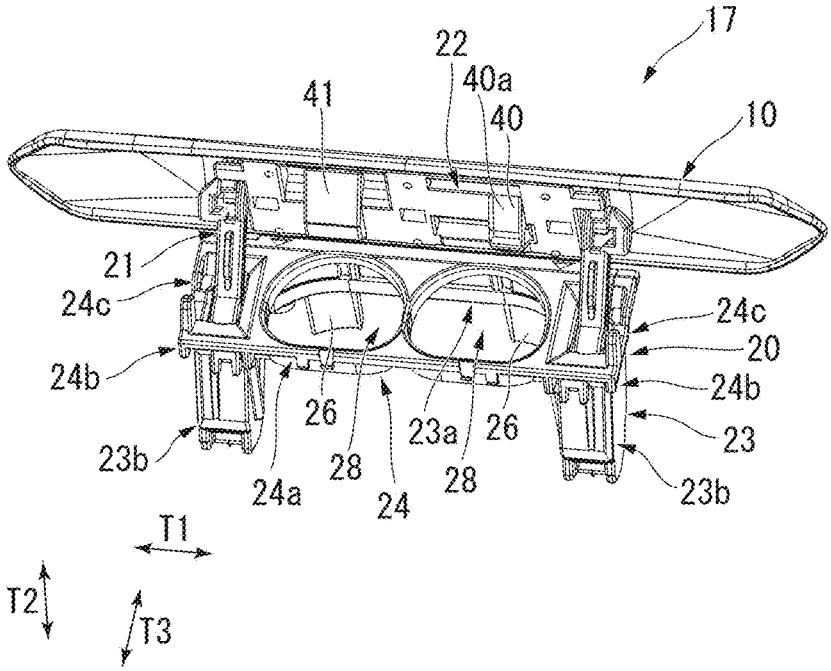
FIG. 8 is perspective view showing a shutter unit of a flushing-type toilet bowl according to one embodiment of the present invention and is a diagram showing a state in which a shutter is open to the upper side.
Figure 9:
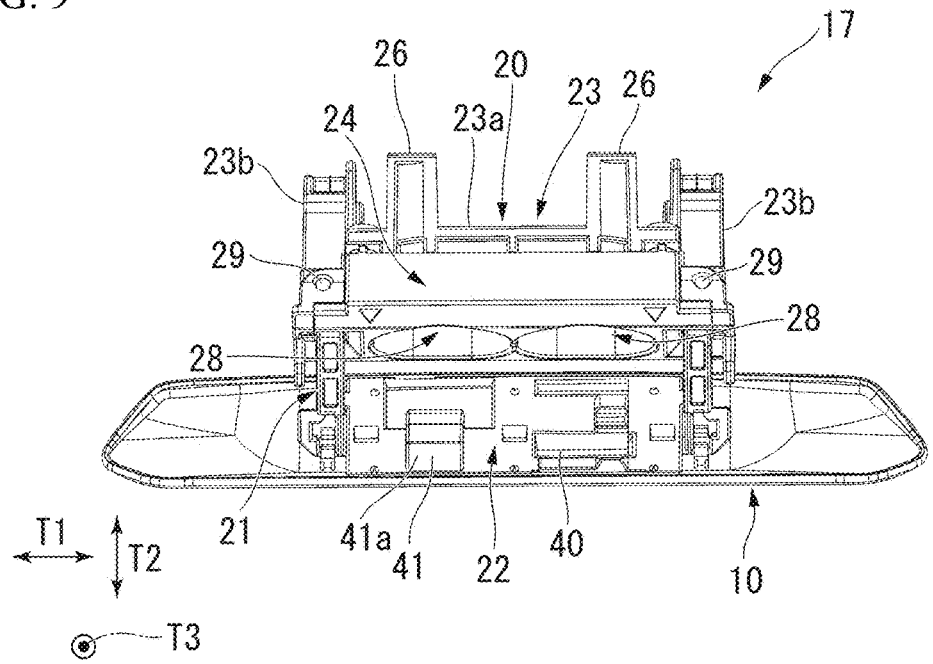
FIG. 9 is perspective view showing a shutter unit of a flushing-type toilet bowl according to one embodiment of the present invention and is a diagram showing a state in which the shutter is open to the lower side.
Figure 15:
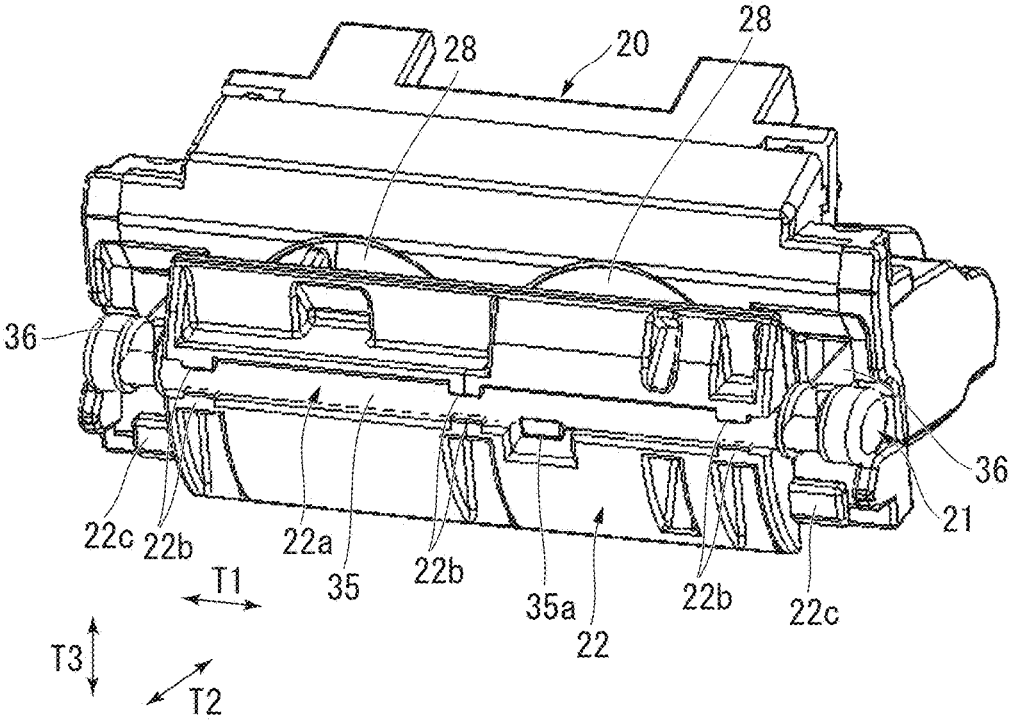
FIG. 15 is a perspective view showing a state in which a shutter receiver is attached to a shaft part of a shutter arm of a shutter unit of a flushing-type toilet bowl according to one embodiment of the present invention.

The shutter receiver 22, as shown in FIGS. 8, 9, and 15, is formed in an approximately horizontally-long rectangular plate shape in the front view. In addition, the shutter receiver 22 includes a rotation shaft fitting part 22*a* that is recessed from the front surface to the rear surface side and extends from one end portion to the other one end portion in the horizontal direction of the longitudinal direction at the approximately center in the vertical direction of the traverse direction. On the front surface of the shutter receiver 22, a plurality of locking piece parts 22*b* slightly protruding on the rotation shaft fitting part 22*a* are provided in the upper side and the lower side having the rotation shaft fitting part 22*a* interposed therebetween.

In the shutter receiver 22, in each of both end portion sides on a further lower side than the rotation shaft fitting part 22*a*, a rotation regulating part 22*c* protruding from the side end portion in the horizontal direction T1 is provided.

On the rear surface of the shutter receiver 22, a first contact rotation part 40 is provided at a position with which the tip end part of one private part cleaning nozzle 7 is brought into contact when the one private part cleaning nozzle 7, which is used for cleaning the anus, of the nozzle unit 11 advances to the front side. In addition, on the rear surface of the shutter receiver 22, a second contact rotation part 41 is provided at a position with which the tip end part of the other private part cleaning nozzle 8 is brought into contact when the other private part cleaning nozzle 8, which is used for the bidet, advances to the front side.

Each of the first contact rotation part 40 and the second contact rotation part 41 is formed to protrude from the rear surface of the shutter receiver 22 to the rear side. The first contact rotation part 40 is formed to include an inclining face 40*a* that is closer to the rear surface toward the lower side at a portion with each the one private part cleaning nozzle 7 is brought into contact. The second contact rotation part 41 is formed to include a reverse inclining face 41*a* that is further separate away from the rear surface to the rear side as the portion with which the other private part cleaning nozzle 8 is brought into contact is toward the lower side.

The shutter 10, as shown in FIGS. 5 to 8, is formed in an approximately rectangular shape, which is horizontally long, in the front view and is formed in an approximately arc shape cross-section that is curved such that a center portion in the vertical direction in the state in which the nozzle opening 9 is closed is slightly swollen.

The warm water supplying unit according to this embodiment is connected to each of the private part cleaning nozzles 7 and 8 of the nozzle unit 11 with piping. This warm water supplying unit is driven on the basis of an operation direction from a control board and supplies warm water of which the temperature is adjusted to a predetermined temperature to the private part cleaning nozzles 7 and 8 as cleaning water.

Figure 16:
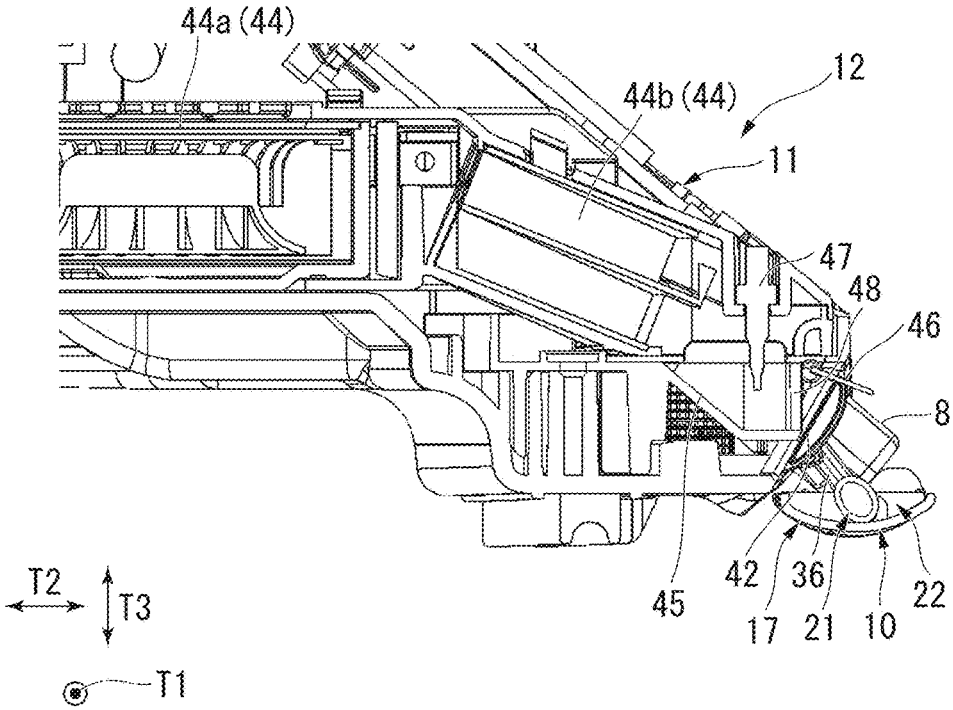
FIG. 16 is a side cross-sectional view showing a state at the time of drying cleaning water adhering to a human body after cleaning using warm air.
Figure 17:
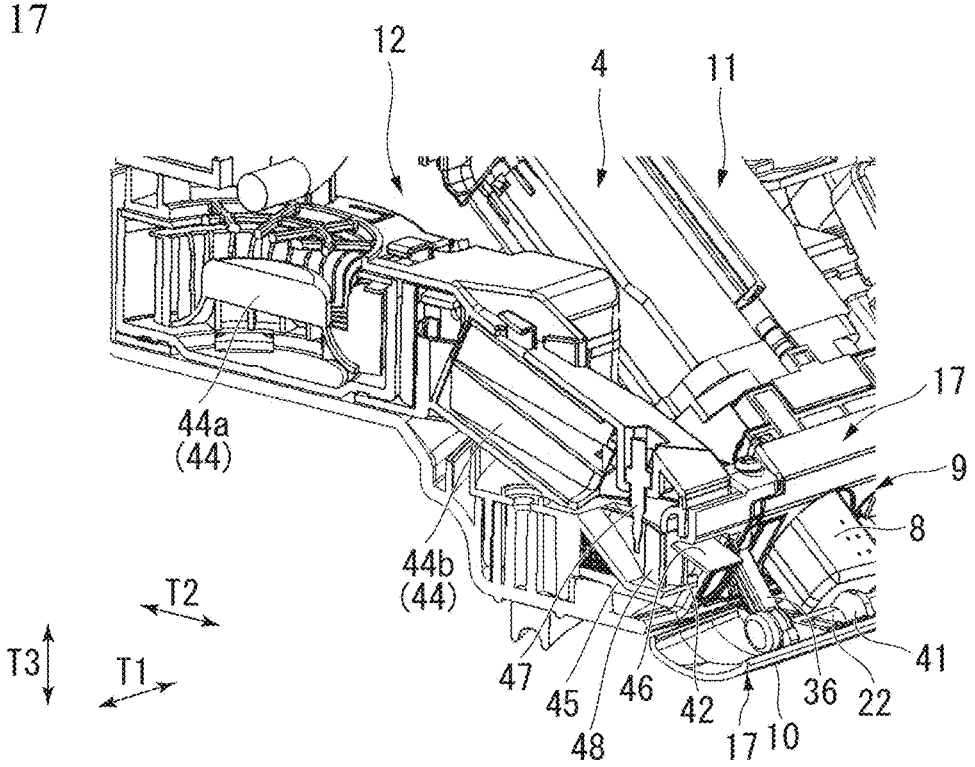
FIG. 17 is a perspective view showing a state at the time of drying cleaning water adhering to a human body after cleaning using warm air.
Figure 18:
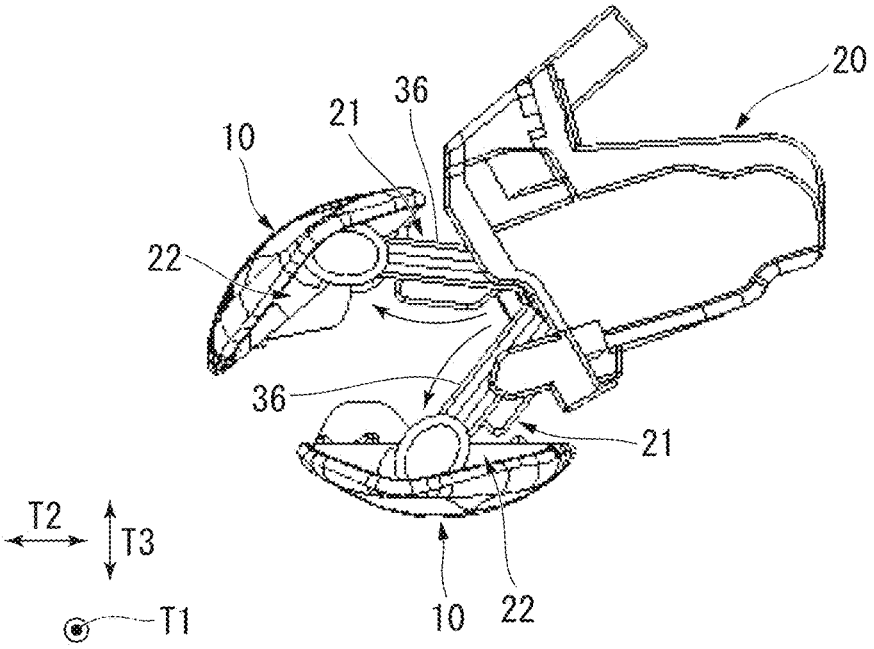
FIG. 18 is a side view showing a state in which a shutter of a shutter unit of a flushing-type toilet bowl according to one embodiment of the present invention is open toward two sides including the upper side and the lower side.

The warm air drying unit 12 according to this embodiment, as shown in FIGS. 16 and 17, includes a warm air generating device 44 and a warm air duct 45. The warm air duct 45 is provided to be connected to an outlet 42 that is open to be aligned with the nozzle opening 9.

The warm air generating device 44 includes a fan 44*a* that is provided in the middle of the warm air duct 45 and a heater 44*b* that is provided in a further outlet 42 side than the fan 44*a* of the warm air duct 45. This warm air generating device 44 circulates air (outer air) drawn according to the driving of the fan 44*a* through the warm air duct 45, heats the outer air up to the predetermined air using the heater 44*b*, and blows out the air from the outlet 42 in a predetermined direction on the front side.

In the warm air generating device 44 according to this embodiment, an air direction adjusting unit (not shown in the drawing) adjusting the flow direction of the warm air blown from the outlet 42 in the horizontal direction is provided in the outlet 42. This air direction adjusting unit, for example, is configured by a plate-shaped member that is hit by warm air and guides the warm air in a predetermined horizontal direction and the like.

In the warm air duct 45, on a further outlet 42 side than the heater 44*b*, a thermistor (temperature detecting device) 47 is arranged. In the warm air drying unit 12 according to this embodiment detects the temperature of the warm air using this thermistor 47 and controls the driving of the heater 44*b*.

In the warm air drying unit 12 according to this embodiment, a lid member 46 that is freely rotatable is provided in the outlet 42. In the warm air drying unit 12, this lid member 46 is rotated to open the outlet 42 together with the blowing of warm air and closes the outlet 42 together with stopping the blowing of warm air.

The deodorizing unit 13 according to this embodiment includes a deodorizing duct, a fan (air blower) that is provided in the middle of the deodorizing duct, a deodorizing cartridge arranged inside the deodorizing duct on a further upstream side than the fan, and a sterilization unit that is arranged on a further downstream side than the fan.

The deodorizing duct, for example, has one end provided in the upstream side connected to an inlet that is open to be aligned with the nozzle opening 9 and has the other end provided in the downstream side connected to a further downstream side than the heater 44*b* of the air duct 45. In other words, in this case, the downstream side of the warm air duct 45 and the downstream side of the deodorizing duct are used as a common passage, and the warm air duct 45 and the deodorizing duct are configured to be used also as the outlet 42. In addition, in a connection portion between the deodorizing duct and the warm air duct 45, a damper used for performing switching between passages and adjusting the flow rate is provided, and an opening ratio between the warm air duct 45 and the deodorizing duct can be adjusted according to a control angle of the damper.

The deodorizing cartridge, for example, includes deodorant of an adsorption type such as activated carbon and removes a bad smell included in passing air using the deodorant. Here, the deodorant is not particularly limited, as long as deodorization can be performed. For example, the deodorant may be a catalyst and may be deodorant of a resolving type such as a photocatalyst resolving a material by emitting rays such as ultraviolet rays.

The sterilization unit, for example, suppresses the proliferation of floating fungi and performs sterilization, and a sterilization unit may be appropriately used which generates positive ions and negative ions by ionizing the air and inactivates floating fungi by surrounding them using the positive ions and the negative ions.

In the flushing-type toilet bowl A according to this embodiment configured as described above, first, as shown in FIGS. 10, 11, and 13, the rear surface of the second base 24 is engaged with the front surface of the first base 23 of the shutter base 20 while causing a surface contact therebetween to cause the first base 23 and the second base 24 to be in the bonding state. At this time, while the arm parts 36 of the shutter arm 21 are arranged to be inserted inside a space of one pair of the arm holding parts 23*b* (and the arm insertion parts 24*c*) that are provided in end portions on both sides of the first base 23 and the second base 24 in the width direction and communicate with each other, the first base 23 and the second base 24 are engaged with each other, and, by inserting and screwing the screw 34 into the screw insertion hole 27 of the main body part 23*a* of the first base 23 and the female screw hole of the main body part 24*a* of the second base 24 communicating with each other, the first base 23 and the second base 24 are integrally connected.

When the first base 23 and the second base 24 are connected, as shown in FIGS. 13, 14, and 15, the shaft part 35 of the shutter arm 21 is arranged to have the direction of the axial line O3 toward the horizontal direction T1, and the arm parts 36 are maintained to be freely advance or retreat in the forward-backward direction T2 inside the space of the arm holding part 23*b* and the arm insertion part 24*c*.

By bringing the upper rotation surface 37*a* and the lower rotation surface 37*b*, which have arc surface shapes, of the rotation part 37 provided in the rear end sides of the arm parts 36 of the shutter arm 21 into contact with the upper rotation engaging surface 31 and the lower rotation engaging surface 32 of the arm insertion part 24*c* of the first base 23, the arm parts 36 are held to be freely advance and retreat in the forward-backward direction T2 inside the space of the arm holding part 23*b* and the arm insertion part 24*c*. In addition, as shown in FIGS. 13, 14, 15, and 18, the upper rotation engaging surface 31 and the upper rotation surface 37*a* are brought into surface contact with each other, the upper rotation engaging surface 31 and the upper rotation surface 37*a* slide over each other, the lower rotation engaging surface 32 and the lower rotation surface 37*b* are brought into surface contact with each other, and the lower rotation engaging surface 32 and the lower rotation surface 37*b* slide over each other, whereby each arm part 36 is held to be freely rotatable in the vertical direction.

In addition, as the rib 38 provided in each arm part 36 is engaged with the guide groove 33 provided in the lower rotation engaging surface 32 of the arm insertion part 24*c*, each arm part 36 is guided in the forward-backward direction T2 along the direction of the axial line O4 to advance or retreat. In addition, since the rib 38 is engaged with the guide groove 33, the shutter arm 21 maintains the direction of the axial line O4 of the arm part 36 to be in the forward-backward direction T2 along the direction of the axial line of the arm holding part 23*b* and the arm insertion part 24*c*. In other words, since the rib 38 is engaged with the guide groove 33, while the arm part 36 does not incline to the lower side due to the weight of the shutter arm 21 or the like, the arm part is held to be freely advance or retreat inside the space of the arm holding part 23*b* and the arm insertion part 24*c*.

Here, the rib 38 according to this embodiment is formed to include the inclining part (R-shaped part) 38*b* having the protruding length decreased toward the rear end on the rear end side. Accordingly, when the arm part 36 advances to the front side, and a state in which only the inclining part 38*b* is engaged with the guide groove 33 is formed, as the arm part 36 advances to the front side, the arm part 36 inclines toward the lower side. Then, when the arm part 36 further advances to the front side, and the inclining part 38*b* deviates from the guide groove 33, the upper rotation engaging surface 31 and the upper rotation surface 37*a* and the lower rotation engaging surface 32 and the lower rotation surface 37*b* are brought into surface contact, and each arm part 36 is held to be freely rotatable in the vertical direction T3.

Next, as described above, in a stage in which the first base 23 and the second base 24 are assembled, and the shutter base 20 and the shutter arm 21 are connected, the shaft part 35 of the shutter arm 21 is fitted into the rotation shaft fitting part 22*a*, and the locking piece parts 22*b* and 35*b* thereof are engaged with each other, and the shutter receiver 22 is detachably attached to the shaft part 35 of the shutter arm 21. In addition, the shutter receiver 22 is attached to a predetermined position on the shaft part 35 of the shutter arm 21 by the locking piece parts 22*b* and 35*a*, and the rotation regulating part 22*c* protruding from the side end portion of the shutter receiver 22 in the horizontal direction T1 is arranged at a position superimposed in the vertical direction T3 of the arm part 36 of the shutter arm 21.

In this way, as shown in FIGS. 8, 9, 13, 14, 15, and 18, the shutter receiver 22 is arranged to the freely rotatable around the axial line O3 of the shaft part 35 of the shutter arm 21. In addition, as the rotation regulating part 22*c* is brought into contact with the arm part 36 at the time of rotation, the arm part 36 is arranged in a state in which the rotation range (the amount of rotation) thereof is regulated without the rear surface directed toward the front side.

Here, by forming the shutter receiver 22 (and the shutter arm 21 (the shaft part 35)) using a polyethylene resin or the like, a wear or an abnormal noise does not occur at the time of bringing the private part cleaning nozzles 7 and 8 into contact or at the time of rotation to be described later.

Figure 19:
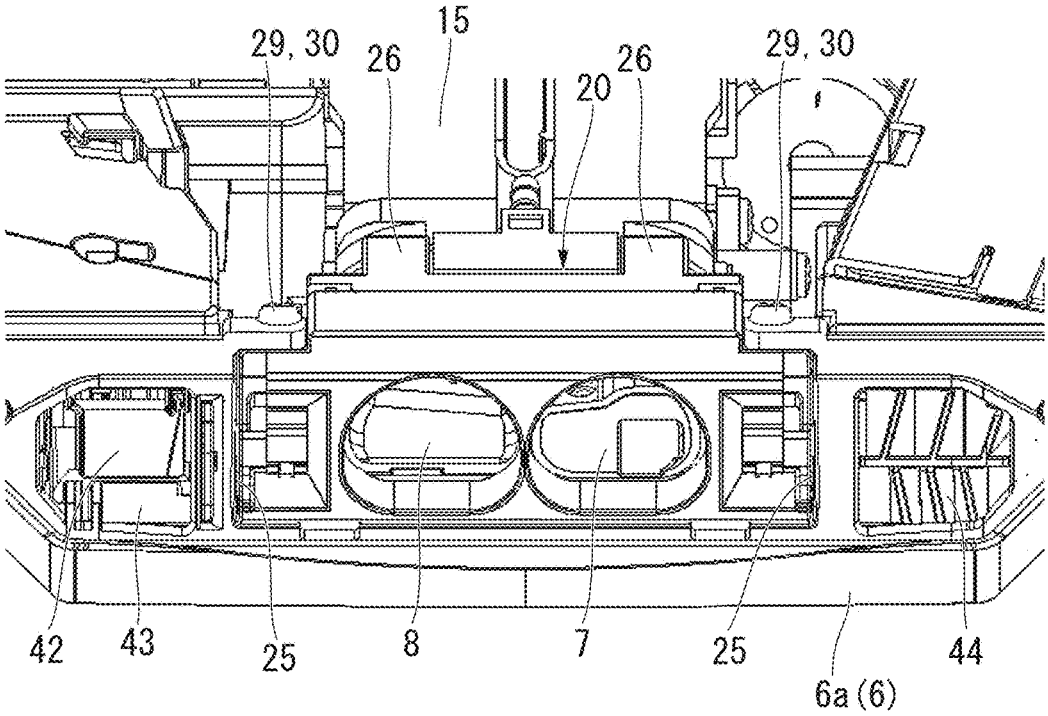
FIG. 19 is a perspective view on the front side showing a state in which a shutter base of a shutter unit of a flushing-type toilet bowl according to one embodiment of the present invention is installed in a nozzle opening.
Figure 20:
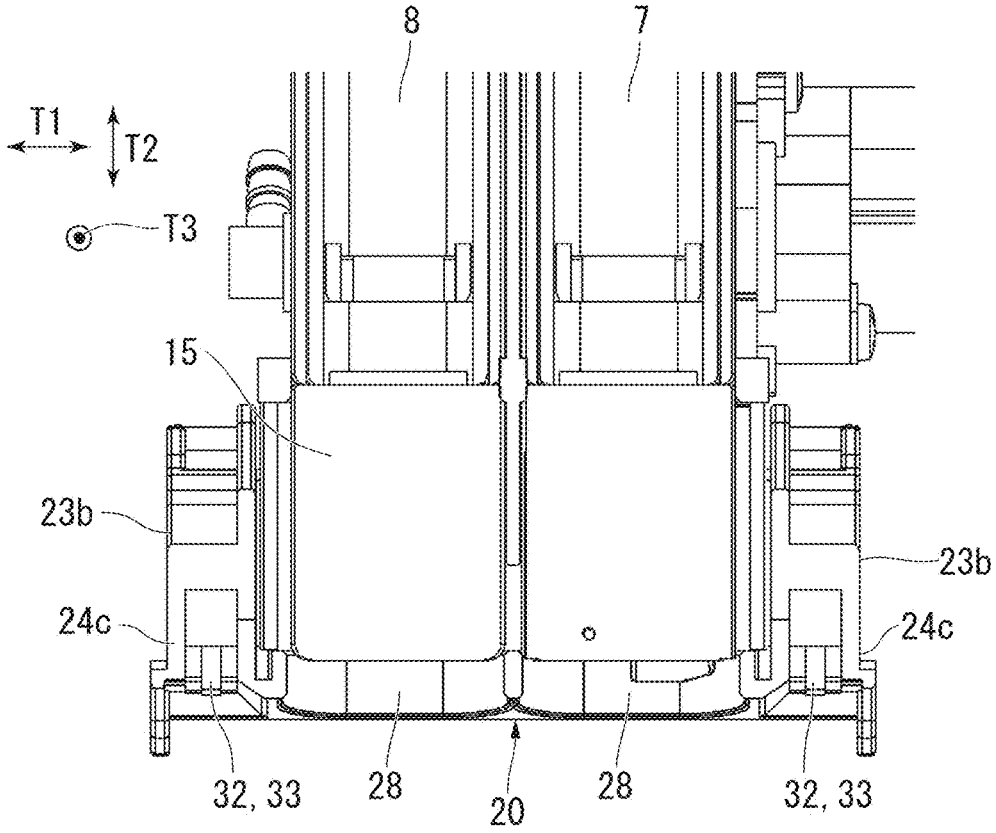
FIG. 20 is a plan view showing a state in which a shutter base of a shutter unit of a flushing-type toilet bowl according to one embodiment of the present invention is installed in a nozzle opening.

Next, as shown in FIGS. 6, 19, and 20, the fitting part 25 of the main body part 23*a* of the first base 23 of the shutter base 20 is fitted to the nozzle cover 15, the projecting part of the nozzle cover 15 is engaged between the one pair of the engagement projecting parts 26 of the main body part 23*a* of the first base 23 of the shutter base 20, whereby the shutter unit 17 (the shutter base 20, the shutter arm 21, and the shutter receiver 22) is installed in the nozzle opening 9 of the base 6*a*.

When the shutter unit 17 is installed in the nozzle opening 9 of the base 6*a*, the female screw hole 29 provided in the upper end side of the arm insertion part 24*c* of the second base 24 and the screw insertion hole of the base of the cover case 6 communicate with each other. By fastening the screw 30 into the female screw hole 29 through the screw insertion hole, the shutter unit 17 is fixed to a predetermined position on the base 6*a*.

Then, as the shutter unit 17 is fixed to the predetermined position on the base 6*a*, the nozzle cover 15 (the nozzle unit 11) that is fitted to and engaged with the shutter base 20 is held with the vertical and horizontal positions thereof determined by the shutter unit 17. At this time, the shutter base 20 and the nozzle unit 11 are held in the state of being connected such that a large gap is not generated in a connection portion thereof, in other words, the connection faces thereof are brought into surface contact.

Next, the shutter 10 is engaged to be detachable attached to both end sides (the front end sides of the arm parts 36) of the shaft part 35 of the shutter arm 21 to be rotatable around the axial line O3 by opposing the front surface and the rear surface of the shutter receiver 22. In the stage in which the shutter 10 is attached, the spring member is connected to the base 6*a* and the arm part 36 by hanging the spring member over the spring connection part 36*a* of the other end side (the rear end side) of the arm part 36.

In this way, a force biasing the shutter arm 21 to the rear side inside the cover case 6 is applied by the spring member, each arm part 36 is retracted and housed into the rear side inside the space of the arm insertion part 24*c* and the arm holding part 23*b*, the shaft part 35 and the shutter receiver 22 are arranged near the front surface of the shutter base 20, and the shutter 10 is closely arranged such that the rear surface thereof faces the front surface of the shutter base 20 together with the shutter receiver 22. Accordingly, in this state, the shutter 10 closes the nozzle opening 9 with the front surface thereof directed toward the inner side of the toilet main body 1.

In this embodiment, the shutter 10 is formed to be horizontally long, the warm air drying unit 12 and the inlet 43, the outlets 42 and 44 of the deodorizing unit 13 are configured to be closed at the same time together with the nozzle opening 9.

Next, a method of performing cleaning of the private part and warm air drying of the private part by using the private part cleaning device 4 after defecation using the flushing-type toilet bowl A according to this embodiment will be described.

First, after defecation, for example, when a user performs a remote controller operation of an anus cleaning button, a control device detects the operation and gives an operation direction, and the motor and the pinion rotate in one direction, and thus, one private part cleaning nozzle 7 that is a nozzle for cleaning the anus advances to the front side.

Figure 21:
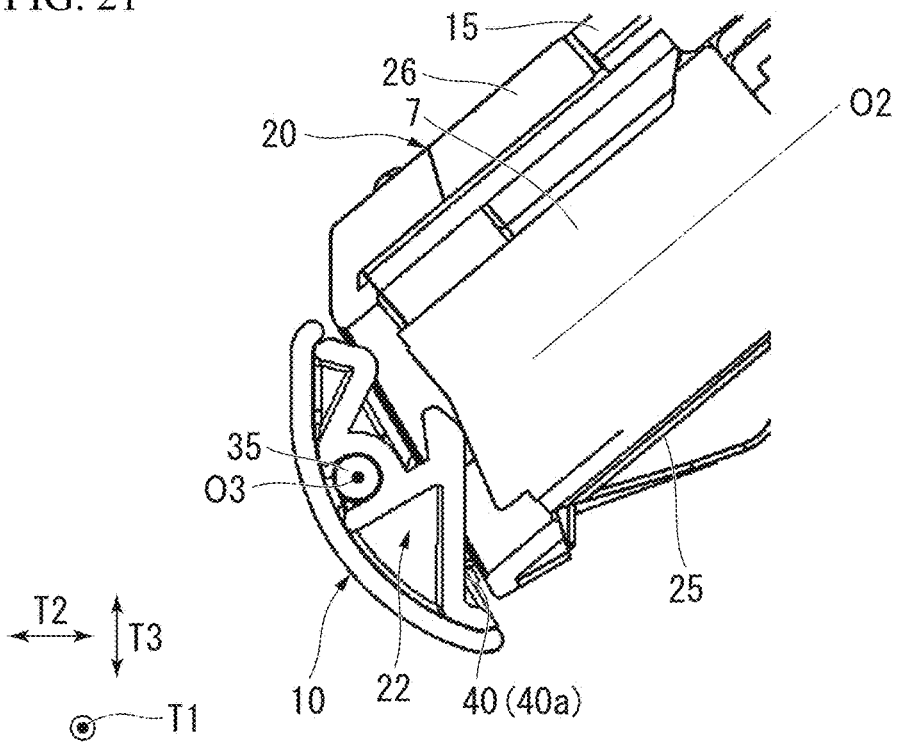
FIG. 21 is a side cross-sectional view showing a state in which a shutter of a shutter unit of a flushing-type toilet bowl according to one embodiment of the present invention closes a nozzle opening.
Figure 22:
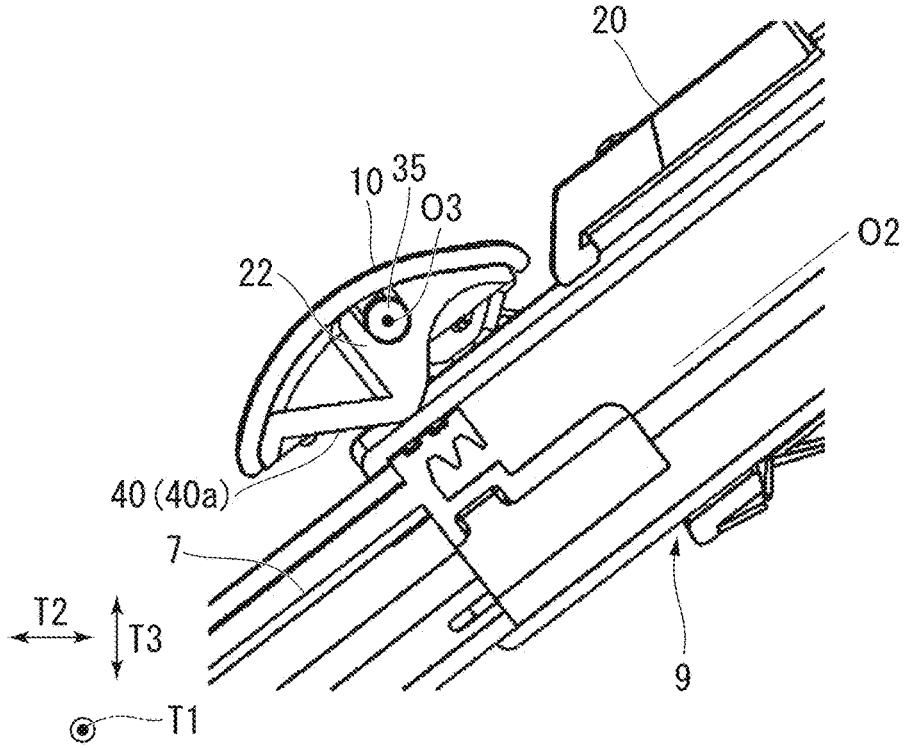
FIG. 22 is a side cross-sectional view showing a state in which a shutter of a shutter unit of a flushing-type toilet bowl according to one embodiment of the present invention is open toward the upper side.

At this time, as shown in FIGS. 6, 8, 9, and 18, on the rear surface of the shutter receiver 22, the first contact rotation part 40 including the inclining face 40*a* that is gradually closer to the rear surface as it faces a position facing the one private part cleaning nozzle 7 in the lower side is provided. For this reason, when the one private part cleaning nozzle 7 advances to have the tip end being brought into contact with the inclining face 40*a* of the first contact rotation part 40 and further advances, the inclining face 40*a* of the first contact rotation part 40 is pressed, and, as shown in FIGS. 8, 21, and 22, the shutter receiver 22 rotates to the upper side such that the rear surface thereof faces the lower side in accordance with the shape of the first contact rotation part 40 (inclining face 40*a*).

Since the shutter 10 is provided to be superimposed on the shutter receiver 22, the shutter 10 is pressed by the shutter receiver 22 to follow the operation, and the shutter 10 is configured to rotate to the upper side such that the rear surface faces the lower side.

In addition, as shown in FIGS. 6, 8, 9, 13, 18, 21, and 22, the rib 38 is provided in the arm part 36, and as the rib 38 is guided with being engaged with the arm holding part 23*b* and the guide groove 33 formed in the arm insertion part 24*c*, the rib 38 is directed toward the front side together with the advancement of the one private part cleaning nozzle 7, and the shutter arm 21 and, furthermore, the shutter receiver 22 and the shutter 10 advance appropriately.

Together with further advancement of the one private part cleaning nozzle 7, the upper rotation surface 37*a* and the lower rotation surface 37*b*, which have arc surface shapes, of the rotation part 37 of the arm part 36 are respectively brought in to surface contact with the upper rotation locking surface 31 and the lower rotation locking surface 32 of the shutter base 20, and the arm part 36 smoothly rotates around the rotation part 37 to raise the tip end side.

At this time, as the support protrusion part 38*a* of the rib 38 is engaged with the guide groove 33, the arm part 36 at a time when the arm part 36 advances to the front side and, furthermore, the shutter receiver 22 and the shutter 10 do not move backward. In this way, the one private part cleaning nozzle 7 advances while pressing the inclining face 40*a* of the first contact rotation part 40 by the tip end part of the private part cleaning nozzle 7, the upper rotation surface 37*a* and the lower rotation surface 37*b* of the rotation part 37 of the arm part 36 are respectively brought into surface contact with the upper rotation locking surface 31 and the lower rotation locking surface 32 of the shutter base 20, and the arm part can be smoothly rotated around the rotation part 37.

In other words, in the flushing-type toilet bowl A, when one private part cleaning nozzle 7 advances, automatically, the shutter 10 rotates around the rotation part 37 to the upper side together with the arm part 36 and rotates around the axial line O3 of the shaft part 35 of the shutter arm 21 to have the rear surface directed to the lower side together with the shutter receiver 22.

In this way, the nozzle opening 9 is open, and warm cleaning water is discharged in accordance with the driving of the warm water supplying unit from the tip end part of one private part cleaning nozzle 7 that has advanced to the inner side of the toilet main body 1, whereby the private part can be cleaned. In addition, at the time of cleaning, above the nozzle opening 9 and above the one private part cleaning nozzle 7, the shutter 10 is arranged to be covered having the front surface directed toward the upper side. For this reason, contaminants, a spray of cleaning water, and the like are blocked by the shutter 10 and are prevented from being caught in the private part cleaning nozzles 7 and 8 and the nozzle opening or entering the inside thereof.

When cleaning of the private part is completed by the one private part cleaning nozzle 7, automatically or in accordance with control according to a user's remote controller operation or the like, the motor and the pinion rotate in the other direction, and the private part cleaning nozzle 7 that is a nozzle for cleaning the anus is retracted to the rear (moved to the rear). In addition, when one private part cleaning nozzle 7 is retracted to the rear, the arm part 36 of the shutter arm 21 is biased to the rear side by the spring member, and automatically, the shutter arm 21 is retracted to the rear.

In order for the one private part cleaning nozzle 7 to retreat to the rear side, the inclining part 38*b* is provided in the rear end side of the rib 38 of the arm part 36. For this reason, the inclining part 38*b* is appropriately re-engaged with the guide groove 33, and the shutter arm 21 is appropriately retracted to the rear. Then, the one private part cleaning nozzle 7 is housed in the cover case 6 through the nozzle opening 9, and the contacting and pressing state of the first contact rotation part 40 is released, and the shutter receiver 22 and the shutter 10 are rotated while retracted to the rear together with the shutter arm 21. Accordingly, the shutter 10 closes the nozzle opening 9 to be returned to the original state.

On the other hand, for example, when a user performs a remote controller operation of a bidet cleaning button, the control device detects the operation and gives an operation direction. In accordance with this operation direction, the motor and the pinion rotate in one direction, and the private part cleaning nozzle 7 that is the nozzle for cleaning the anus advances to the front side, similar to the description presented above, the inclining face 40*a* of the first contact rotation part 40 is pressed, the shutter receiver 22 and the shutter arm 21 are rotated to the upper side while they are caused to move forward, and the shutter 10 is rotated to the upper side such that the rear surface is directed toward the lower side. Accordingly, the nozzle opening 9 is open.

At the time of bidet cleaning, one private part cleaning nozzle 7 opens the shutter 10 and stops in the state being arranged on the lower side of the shutter 10 and does not further advance to the inner side of the toilet main body 1.

In a stage in which the shutter 10 is open by the one private part cleaning nozzle 7, the other private part cleaning nozzle 8 that is the nozzle for bidet cleaning advances to the front side and advances up to a predetermined position on the inner side of the toilet main body 1 without being brought into contact with the shutter 10. Warm cleaning water is discharged from the tip end part of the other private part cleaning nozzle 8 that has advanced to the inner side of the toilet main body 1 by driving the warm water supplying unit, thereby a private part can be cleaned. In addition, at the time of this cleaning, the shutter 10 is arranged to be covered having the front surface directed toward the upper side above the nozzle opening 9 and above the one private part cleaning nozzle 7 and the other private part cleaning nozzle 8. For this reason, cleaning water, contaminants, a spray of the cleaning water, and the like are blocked by the shutter 10, and it is prevented that the spray is caught in or enters the private part cleaning nozzles 7 and 8, the nozzle opening 9, and the insides thereof.

When cleaning of the private part is completed by the other private part cleaning nozzle 8, automatically or in accordance with control according to a user's remote controller operation or the like, the motor and the pinion rotate in the other direction, and the private part cleaning nozzle 8 that is the nozzle for bidet cleaning is retracted to the rear and is returned to its original position inside the cover case 6 through the nozzle opening 9.

Together with this, the one private part cleaning nozzle 7 is retracted to the rear. At this time, the arm part 36 of the shutter arm 21 is biased to the rear side by the spring member. For this reason, the shutter arm 21 is automatically retracted to the rear.

In addition, the inclining part 38*b* is provided in the rear end side of the rib 38 of the arm part 36. For this reason, in order for the one private part cleaning nozzle 7 to retreat and is retracted to the rear, the inclining part 38*b* appropriately is re-engaged with the guide groove 33, and the shutter arm 21 is appropriately retracted to the rear. Then, the one private part cleaning nozzle 7 is housed in the cover case 6 through the nozzle opening 9, and the contacting and pressing state of the first contact rotation part 40 is released, and the shutter receiver 22 and the shutter 10 are rotated while retracted to the rear together with the shutter arm 21. Accordingly, the shutter 10 closes the nozzle opening 9 to be returned to the original state.

Next, as described above, after cleaning is performed using the one private part cleaning nozzle 7 used for cleaning the anus or the other private part cleaning nozzle 8 used for bidet cleaning, automatically or in accordance with a user's remote controller operation, the warm air drying unit 12 is driven, and the private part is dried using the warm air.

At the time of warm air drying, in the flushing-type toilet bowl A according to this embodiment, first, after cleaning is performed using the one private part cleaning nozzle 7 that is used for cleaning the anus or the other private part cleaning nozzle 8 that is used for bidet cleaning, in a stage in which a predetermined time elapses or in a stage in which a user performs a remote controller operation of the warm air drying button or the like, the control device detects the elapse of time, the remote controller operation, or the like. Together with this, the control device gives an operation direction, and the motor and the pinion rotate in one direction, and the private part cleaning nozzle 8 that is the nozzle for bidet cleaning advances to the front side.

At this time, as shown in FIGS. 6, 13, 15, 16, 17, and 18, on the rear surface of the shutter receiver 22, the other contact rotation part 41 including the reverse inclining face 41*a* that is gradually separate away from the rear surface toward the lower side and that is provided in a position facing the other private part cleaning nozzle 8. For this reason, the other private part cleaning nozzle 8 advances, and the tip end thereof is brought into contact with the reverse inclining face 41*a* of the other contact rotation part 41. When the other private part cleaning nozzle 8 further advances, the reverse inclining face 41*a* of the other contact rotation part 41 is pressed, and the shutter rotates to the lower side such that the shutter receiver 22 has the rear surface directed toward the upper side in accordance with the shape of the reverse inclining face 41*a*.

The rib 38 is provided in the arm part 36, and the rib 38 is guided by being engaged with the guide groove 33 formed in the arm insertion part 24*c*, whereby, together with the advancement of the other private part cleaning nozzle 8, the shutter arm 21 and, furthermore, the shutter receiver 22 and the shutter 10 appropriately advance toward the front side.

When the other private part cleaning nozzle 8 further advances while pressing the reverse inclining face 41*a* of the other contact rotation part 41, the upper rotation surface 37*a* and the lower rotation surface 37*b* of the rotation part 37 of the arm part 36 are brought into surface contact with the upper rotation locking surface 31 and the lower rotation locking surface 32 of the shutter base 20. Together with this, the rib 38 is gradually dropped out from the guide groove 33 along the inclining part 38*b*, and the arm part 36 smoothly rotates around the rotation part 37 to lower the tip end side.

In this way, when the other private part cleaning nozzle 8 advances, automatically, the shutter 10 rotates around the rotation part 37 to the lower side together with the arm part 36 and rotates around the axial line O3 of the shaft part 35 of the shutter arm 21 to have the rear surface directed toward the upper side together with the shutter receiver 22.

At this time, the rotation regulating part 22*c* protruding from the side end portion in the horizontal direction T1 is provided in the shutter receiver 22. For this reason, the rotation regulating part 22*c* is brought into contact with the arm part 36 from the lower side, and accordingly, further rotation of the shutter receiver 22 and, furthermore, the shutter 10 is regulated, and the shutter 10 (the shutter receiver 22) is held in a state in which the rear surface is directed to the upper side.

In addition, in order to perform an open operation of the shutter 10 at the time of warm air drying, the other private part cleaning nozzle 8 opens the shutter 10, and the shutter stops in a state in which the tip end part of the private part cleaning nozzle 8 is arranged above the shutter 10, and the shutter does not further advance to the inner side of the toilet main body 1.

In this embodiment, in a state in which the shutter 10 is rotated to the lower side such that the rear surface is directed toward the upper side, the warm air drying unit 12 is driven, and warm air is blown out from the outlet 42 opening near the nozzle opening 9.

As the warm air blowing out from the outlet 42 arrives at an air direction adjusting unit 46 provided in the outlet 42, the air blowing direction in the horizontal direction is adjusted. In this way, the warm air arrives at a predetermined position on the rear surface of the shutter 10 and is reflected on the rear surface of the shutter 10, and the warm air is blown and irradiated toward a private part.

In this way, according to the flushing-type toilet bowl A of this embodiment, the range in which the warm air is sprayed for a human body is increased more than that of a case where a private part is dried using a conventional warm air nozzle, and cleaning water adhering to the human body is efficiently dried by the warm air.

Here, it is preferable that, for the shutter 10 arranged to have the rear surface directed toward the upper side, the center of the air flow of the warm air blown out from the outlet 42 hits a front-side portion (a portion provided in the upper side of the shutter 10 in the vertical direction T3 in the closed state) of the inner side of the toilet main body 1 more than the center of the shutter 10 in the forward-backward direction T2. In such a case, the occurrence of loss according to the warm air blown to the rear side (the rear side of the toilet main body 1) of the shutter 10 is suppressed.

In addition, as shown in FIGS. 16 and 17, it is preferable that the rear surface part of the shutter 10 at which warm air arrives is formed in a smooth curved shape having a recessed arc shape. Also in such a case, since warm air arriving at the rear surface of the shutter is effectively reflected on the smooth rear surface part to a private part of a human body, the occurrence of loss of the warm air due to the arrival of the warm air at the rear side of the shutter (the rear side of the toilet main body 1) can be suppressed.

In addition, by causing the other private part cleaning nozzle 8 to advance to be in an open state of the shutter 10 in which the rear surface is directed toward the upper side, the shutter may be swung by repeatedly causing the other private part cleaning nozzle 8 to advance and retreat forward and backward by a predetermined advancement-retreatment amount. In such a case, by blowing out warm air toward the rear surface of the swinging shutter 10, the air blowing range of the warm air that arrives at and is reflected on the rear surface of the shutter 10 is increased, the cleaning water adhering to the human body is dried efficiently and effectively.

In a stage in which the drying of the private part is completed, automatically or in accordance with control according to a user's remote controller operation or the like, the motor and the pinion rotate in the other direction, and the other private part cleaning nozzle 8 that is the nozzle for bidet cleaning is retracted to the rear side and is returned to its original position inside the cover case 6 through the nozzle opening 9.

At this time, the inclining part 38*b* is provided in the rear end side of the rib 38 of the arm part 36. For this reason, even when the arm part 36 is housed in the lowered state, the inclining part 38*b* is appropriately re-engaged with the guide groove 33 to be guided, and the arm part 36 gradually is lifted by the inclining part 38*b*, and the shutter arm 21 is appropriately retracted to the rear side. Then, the other private part cleaning nozzle 8 is housed in the cover case 6 through the nozzle opening 9, and the contacting and pressing state of the other contact rotation part 41 is released, and the shutter receiver 22 and the shutter 10 rotate while being retracted to the rear side together with the shutter arm 21. Accordingly, the shutter 10 closes the nozzle opening 9 and is returned to its original state.

Accordingly, in the flushing-type toilet bowl A (toilet device) A according to this embodiment, at the time of cleaning a private part, the shutter 10 rotates above the nozzle opening 9 and, furthermore, the private part cleaning nozzles 7 and 8, and, at the time of warm air drying, the shutter 10 rotates below the nozzle opening 9 and, furthermore, the private part cleaning nozzles 7 and 8, and the shutter 10 is configured to rotate in two directions including the forward direction and the reverse direction to open or close the nozzle opening. Therefore, at the time of warm air drying, warm air can be blown out toward the rear surface directed toward the upper side of the shutter 10 rotated to the lower side, and the warm air can be delivered to the private part side by being reflected on the rear surface of the shutter 10.

In this way, by delivering warm air to the private part side by reflecting the warm air on the shutter 10, compared to a conventional case, even when the warm air is blown out in a fixed direction from the outlet 42, by reflecting the warm air on the rear surface of the shutter 10, the warm air can be delivered to a wide range of the private part side.

In addition, by adjusting and controlling the rotation angle of the shutter 10 at the time of warm air drying, the blowing direction of the warm air reflected on the rear surface of the shutter 10 can be easily adjusted and controlled, and an arbitrary drying position can be easily set.

In this way, according to the flushing-type toilet bowl A of this embodiment, compared to a conventional case, after cleaning a private part, cleaning water adhering to a human body can be dried efficiently and effectively using warm air.

In addition, in the flushing-type toilet bowl A according to this embodiment, by forming a part of the rear surface of the shutter 10, which is hit by the warm air, directed toward the upper side at the time of warm air drying in a smooth recessed curved shape, the warm air blown out to the rear surface of the shutter 10 can be appropriately guided and delivered to a private part side in accordance with the shape of the rear surface.

In this way, the loss of warm air that is blown to deviate much from the private part side is decreased, and the cleaning water adhering to a human body can be dried more efficiently and effectively.

In addition, at the time of warm air drying, the shutter 10 rotated such that the rear surface is directed to the upper side is forwardly and reversely rotate and thereby swing, and accordingly, the warm air blown out toward the rear surface of the shutter 10 can be delivered to a wide range by using the shutter 10.

In this way, the cleaning water adhering to a human body can be dried further more efficiently and effectively. In addition, even in a case where there is a position difference in the private part depending on a user sitting on the toilet seat 3*a*, by blowing out warm air in a wide range by using the swinging shutter 10, the cleaning water can be dried reliably.

In addition, in the flushing-type toilet bowl A according to this embodiment, the shutter 10 is rotated in accordance with the advancement of the private part cleaning nozzle 8. Accordingly, at the time of warm air drying, the private part cleaning nozzle 8 is brought into contact with and presses a further upper side than the center of the shutter 10 in the vertical direction to rotate the shutter 10, and accordingly, a state in which the rear surface is directed toward the upper side is maintained. Then, for the shutter 10 of this state, warm air is blown out from the outlet 42 such that the center of the air flow of the warm air hits a further inner side portion of the toilet main body 1 than the center of the shutter 10, whereby, a load applied from the shutter 10 to the private part cleaning nozzle 8 maintaining the shutter 10 in the state, in which the rear surface is directed toward the upper side, in accordance with the blowing-out of the warm air can be decreased.

In addition, the air direction adjusting unit is provided in the outlet 42 of the warm air, and the warm air can be blown out to the rear surface of the shutter 10 by adjusting the horizontal air direction of the warm air by using the air direction adjusting unit, and it is unnecessary to adjust the horizontal air blowing direction using the shutter 10. In this way, a rib or the like used for the adjustment of the air direction does not need to be arranged on a face of a portion of the rear surface of the shutter 10 at which the warm air is blown out, and the face receiving the warm air can be formed in a smooth face shape, whereby the shutter 10 can be easily cleaned.

In addition, the lid member 46 opens the outlet 42 together with the blowing-out of the warm air, and warm air can be delivered to the private part side by reflecting the warm air on the rear surface of the shutter 10. In addition, when the blowing-out of the warm air is stopped, the outlet 42 of the lid member 46 is closed, and that contaminants, a spray of cleaning water, or the like can be prevented from entering the inside through the outlet 42.

As above, while toilet devices according to embodiments of the present invention have been described, the present invention is not limited to the embodiments described above, and a change can be appropriately made in a range not departing from the concept thereof.

For example, in a case where the shutter 10 is swung, a unit used for swing the shutter is not particularly limited, and, the shutter 10 is not limited to be swung in accordance with the advancement-retreatment of the private part cleaning nozzle 8 unlike this embodiment. In other words, for example, the driving of forward/reverse rotation of a motor is controlled, and the shutter 10 may be swung by using this motor, and a unit that swings the shutter 10 may be appropriately selected.

In addition, in this embodiment, although a shutter opening-closing the outlet 42 of warm air is also used as the shutter 10 opening-closing the nozzle opening 9, a shutter opening-closing the outlet 42 of the warm water may be individually provided.

According to a toilet device of the present invention, compared to a conventional case, warm air can be blown out to a wide range after cleaning a private part to appropriately dry the private part, and, after the cleaning of the private part, cleaning water adhering to a human body can be dried efficiently and effectively by using the warm air.

REFERENCE SIGNS LIST

1 Toilet main body
1*a* Ball part
1*b* Rim part
1*c* Water sealing part
2 Cleaning mechanism unit
3 Toilet seat unit
3*a* Toilet seat
3*b* Toilet lid
4 Private part cleaning device
6 Cover case
6*a* Base (base plate)
6*b* Cover (outer shell body)
7 One private part cleaning nozzle (nozzle for cleaning the anus)
8 Other private part cleaning nozzle (nozzle for bidet)
9 Nozzle opening
10 Shutter
11 Nozzle unit
12 Warm air drying unit (warm air drying device)
12*a* Warm air generating device
12*b* Warm air duct
12*c* Fan
12*d* Heater
13 Deodorizing unit (deodorizing device)
13*a* Deodorizing duct
13*b* Fan (air blower)
13*c* Deodorizing cartridge (deodorizing device)
13*d* Sterilization unit
15 Nozzle cover
16 Discharge hole
17 Shutter unit (shutter opening-closing mechanism)
20 Shutter base
21 Shutter arm
22 Shutter receiver
22*a* Rotation shaft fitting part
22*b* Locking piece part
22*c* Rotation regulating part
23 First base
23*a* Main body part
23*d* Arm holding part
24 Second base
24*a* Main body part
24*b* Base engaging part (engagement part)
24*c* Arm insertion part
25 Fitting part (engagement part)
26 Engagement projecting part (engagement part)
27 Screw insertion hole
28 Nozzle insertion part
29 Female screw hole
30 Screw
31 Upper rotation locking surface
32 Lower rotation locking surface
33 Guide groove
34 Screw
35 Shaft part
35*a* Locking piece part
36 Arm part
36*a* Spring connection part

37 Rotation part
37*a* Upper rotation surface
37*b* Lower rotation surface
38 Rib
38*a* Support protrusion part
38*b* Inclining part
40 First contact rotation part
40*a* Inclining face
41 Second contact rotation part
41*a* Reverse inclining face
42 Outlet
44 Warm air generating device
44*a* Fan
44*b* Heater
45 Warm air duct
46 Lid member
47 Thermistor (temperature detecting device)
A Flushing-type toilet bowl
Q1 Rotation axis
Q2 Axial line
Q3 Axial line
Q4 Axial line
T1 Horizontal direction
T2 Forward-backward direction
T3 Vertical direction

What is claimed is:

1. A toilet device comprising:

a toilet bowl;

a toilet seat unit on top of the toilet bowl; and a cleaning mechanism behind the toilet bowl and the toilet seat unit, the cleaning mechanism comprising:

a private part cleaning device having a private part cleaning nozzle for cleaning a private part, the private part cleaning nozzle configured to advance and retreat through a nozzle opening, wherein the private part cleaning nozzle is configured to discharge cleaning water from a tip end part when advanced through the nozzle opening to the private part;

a warm air drying device configured to dry the private part by blowing warm air from an outlet of the warm air drying device to the private part; and a shutter configured to open and close the outlet of the warm air drying device and the nozzle opening, wherein, when drying the private part by the warm air drying device, the shutter is configured to rotate to a lower side of the outlet such that a rear surface is directed upwards and opens the outlet of the warm air drying device, and wherein the shutter is configured such that the warm air is blown from the outlet of the warm air drying device to the rear surface of the shutter that is directed upwards, and when the warm air hits the rear surface of the shutter, it is directed toward the private part, and wherein the shutter is configured such that a center of an air flow bundle of the warm air blown out from the outlet of the warm air drying device is configured to hit a further front side portion than a center in a forward-backward rotation of the shutter, when the shutter is positioned such that the rear surface is directed upwards.

2. The toilet device of claim 1, wherein a portion of the rear surface of the shutter where the warm air hits is formed in a smooth recessed curved shape configured to direct the warm air to the private part.

3. The toilet device of claim 1, wherein, when drying the private part, the shutter is configured to rotate in a forward and a backward direction.

4. The toilet device of claim 1, comprising an air direction adjusting unit configured to adjust a flow direction of the warm air blown out from the outlet of the warm air drying device.

5. The toilet device of claim 1, comprising a lid member configured to open the outlet, wherein the lid member is open when the warm air is blown from the warm air drying device and closed when the warm air not blown from the warm air drying device.

6. The toilet device of claim 2, wherein, when drying the private part, the shutter is configured to rotate in a forward and a backward direction.

* * * * *